US007399112B2

(12) United States Patent
Haughton et al.

(10) Patent No.: US 7,399,112 B2
(45) Date of Patent: Jul. 15, 2008

(54) LIQUID MIXING SYSTEM FOR CLOSED VESSELS

(75) Inventors: Gary Haughton, Oakville (CA); Alexander Gris, Proton Station (CA)

(73) Assignee: Enersave Fluid Mixers Inc., Oakville, Ontario (CA)

( * ) Notice: Subject to any disclaimer, the term of this patent is extended or adjusted under 35 U.S.C. 154(b) by 301 days.

(21) Appl. No.: 10/556,320

(22) PCT Filed: May 10, 2004 (Under 37 CFR 1.47)

(86) PCT No.: PCT/CA2004/000704

§ 371 (c)(1), (2), (4) Date: Nov. 9, 2005

(87) PCT Pub. No.: WO2004/098762

PCT Pub. Date: Nov. 18, 2004

(65) Prior Publication Data

US 2006/0221766 A1 Oct. 5, 2006

Related U.S. Application Data

(60) Provisional application No. 60/469,026, filed on May 9, 2003.

(51) Int. Cl.
*B01F 11/00* (2006.01)

(52) U.S. Cl. ..... 366/258; 366/278; 366/332

(58) Field of Classification Search ..... 366/255, 366/256, 258, 259, 332, 605, 278
See application file for complete search history.

(56) References Cited

U.S. PATENT DOCUMENTS

| | | | |
|---|---|---|---|
| 52,890 | A | 2/1866 | Ryerson |
| 567,503 | A | 9/1896 | Pelatan et al. |
| 1,345,312 | A | 6/1920 | Blake |
| 1,408,596 | A | 3/1922 | Heinrich |
| 2,064,402 | A | 12/1936 | Bannister et al. |
| 2,557,503 | A | 6/1951 | Hogaboom, Jr. |
| 2,615,692 | A | 10/1952 | Muller |
| 2,661,938 | A | 10/1953 | Kuentzel et al. |
| 3,214,148 | A | 10/1965 | Thomas |
| 3,560,366 | A | 2/1971 | Fisher |
| 3,912,237 | A | 10/1975 | Ostberg et al. |
| 4,054,503 | A | 10/1977 | Higgins |
| 4,125,439 | A | 11/1978 | Fleischmann et al. |
| 4,169,681 | A | 10/1979 | Kato |
| 4,189,362 | A | 2/1980 | Dotson |
| 4,302,318 | A | 11/1981 | Mock |
| 4,319,971 | A | 3/1982 | Good et al. |
| 4,439,300 | A | 3/1984 | Houseman |
| 4,440,616 | A | 4/1984 | Houseman |
| 4,534,914 | A | 8/1985 | Takahashi et al. |
| 5,052,813 | A | 10/1991 | Latto |
| 5,100,242 | A | 3/1992 | Latto |
| 5,738,018 | A | 4/1998 | Burnett |
| 5,813,760 | A | 9/1998 | Strong |
| 5,947,784 | A | 9/1999 | Cullen |
| 6,007,237 | A | 12/1999 | Latto |
| 6,070,348 | A | 6/2000 | Bianchetti |
| 6,830,369 | B2 | 12/2004 | Haughton et al. |
| 7,029,166 | B2 | 4/2006 | Haughton et al. |

FOREIGN PATENT DOCUMENTS

| | | | |
|---|---|---|---|
| DE | 7416500 | | 8/1974 |
| DE | 75 04 145 | U | 6/1975 |
| FR | 1 604 693 | A | 1/1972 |
| FR | 2 605 244 | A | 4/1988 |
| GB | 1 147 378 | A | 4/1969 |
| JP | 63104638 | | 5/1988 |
| JP | 11 184 420 | A | 7/1999 |
| SU | 858 898 | A | 8/1981 |
| SU | 967 541 | A | 10/1982 |
| WO | WO 02/083280 | A1 | 10/2002 |

OTHER PUBLICATIONS

Turner, J.S. Intermittent Release of Smoke from Chimneys. Journal of Mechanical Engineering Science 1960, vol. 2, No. 2, pp. 97-100.
Kendig, F. The Science of Smoke Rings and Doughnuts. Saturday Review, Mar. 18, 1972, pp. 40 and 44.
Maxworthy, T. Turbulent Vortex Rings. J. Fluid Mech. 1974, vol. 64, Part 2, pp. 227-239.

Baird et al. Velocity and Momentum of Vortex Rings in Relation to Formation Parameters. The Canadian Journal of Chemical Engineering, Feb. 1977, vol. 55, pp. 19-26.
Maxworthy, T. Some Experimental Studies of Vortex Rings. J. Fluid Mech. 1977, vol. 81, Part 3, pp. 465-495.
Saffman, P.G. The Number of Waves on Unstable Vortex Rings. J. Fluid Mech. 1978, Vol. 84, Part 4, pp. 625-639.
Rohatgi, A. Mixing Effects and Hydronamics of Vortex Rings. Ph.D. Thesis at McMaster University, Hamilton, Ontario, Jun. 1978.
Pullin, D.I. Vortex Ring Formation at Tube and Orifice Openings, Phys. Fluids 22(3), Mar. 1979, pp. 401-403.
Rohatgi et al. Mixing Effects and Hydrodynamics of Vortex Rings. The Canadian Journal of Chemical Engineering, Aug. 1979, vol. 57, pp. 416-424.
Didden, N. On the Formation of Vortex Rings: Rolling-Up and Production of Circulation. Journal of Applied Mathematics and Physics (ZAMP) 1979, vol. 30, pp. 101-116.
Ontario Ministry of the Environment, Water Resources Branch, Province of Ontario. Hamilton Harbour Study 1977, Mar. 1981, pp. 1-A11.
Rohatgi et al. Gas Absorption at a Liquid Surface Agitated by Vortex Rings. The Canadian Journal of Chemical Engineering, Jun. 1981, vol. 59, pp. 303-309.
Glezer, A. An Experimental Study of a Turbulent Vortex Ring. Ph.D. Thesis at California Institute of Technology, Pasadena, California, 1981.
SU 858 898B (Umanskii, M.P.) Aug. 30, 1981. (abstract), Soviet Patent Abstracts, Week 198225, London: Derwent Publications Ltd., AN 1982-51962E.
SU 967 541 A (Fomenko, Y.) Oct. 23, 1982. (abstract), Soviet Patent Abstracts, Week 198334, London: Derwent Publications Ltd., AN 1983-745919.
Ahmad et al. Mixing of Stratified Liquids. Chem. Eng. Res. Des. May 1985, vol. 63, pp. 157-167.
Latto, B. "New Mixer for Slurries and Stratified Fluids" In: Proc. 12th Int. Conf. on Slurry Technology: Mar. 31-Apr. 3, 1987, New Orleans, Louisiana, U.S.A..
JP 63 104638 A (Masatoshi). Patent Abstracts of Japan, vol. 12, No. 344 (C-528), May 10, 1988 (abstract).
Latto et al. Mixing of Thermally Stratified Fluids by Injecting a Series of Vortex Rings—A Numerical Simulation. Trans IChemE, Sep. 1990, vol. 68, Part A, pp. 457-463.
Latto et al. "Use of Vortex Rings for Mixing". In: Industrial Applications of Fluid Mechanics 1990, ASME, New York, FED, vol. 100, pp. 79-86.
Hua, F. Numerical Simulation and Experimental Study of the Behaviour of Vortex Rings. Ph.D. Thesis at McMaster University, Hamilton, Ontario, 1994.
JP 11 184 420 A (Mistubishi Electric Corp.) Patent Abstracts of Japan, vol. 1999, No. 12, Jul. 9, 1999 (abstract).

*Primary Examiner*—Tony G Soohoo
(74) *Attorney, Agent, or Firm*—Patrick J. Hofbauer; Kevin E. Holbeche

(57) ABSTRACT

A mixing apparatus (21) for use with a vessel (22) having a contiguous sidewall substantially centered about and defining a longitudinal axis (A), the mixing apparatus having a base plate (25) removably mountable atop the vessel, a table frame (55) removably mountable atop the base plate and a housing (42) removably mountable atop the table frame. The apparatus also features a mixing head (30) comprising a generally annular blade body (72) for immersion into the fluids to be mixed within the vessel, the blade body having a centrally positioned hub member (70) defining a substantially vertically directed hub axis, said hub member being attached to and surrounded by a ring portion defining an orifice having a centre of symmetry. A drive shaft (84) is provided for supporting the mixing head within the vessel and extending from the hub member to the housing. A reciprocating drive assembly (40) is mounted within the housing, the reciprocating drive assembly being operatively connectable to the drive shaft for imparting reciprocating longitudinal movement to the mixing head. A linear bearing assembly (90) is mounted on the table frame in proximal relation to the housing, with the drive shaft operatively slidable within the linear bearing assembly. With this arrangement, the mixing apparatus is positionable atop the vessel with the drive shaft, hub axis and centre of symmetry all being substantially aligned with said longitudinal axis. The housing is easily removable for servicing of the apparatus without disassembly of the remainder of the assembly.

38 Claims, 17 Drawing Sheets

LIQUID MIXING SYSTEM FOR CLOSED VESSELS

FIELD OF THE INVENTION

The present invention relates to industrial mixers, and more particularly, to improvements for such mixers having utility in, for example, the mixing of liquids in closed vessels containing explosive or otherwise dangerous gases, such as municipal sewage digesters.

BACKGROUND AND SUMMARY OF THE INVENTION

Numerous types of mixers are known in the prior art which provide for the mixing of liquids in large vessels on a commercial scale to carry out industrial and commercial processes on a substantially continuous, non-batch, basis. Two important examples of such continuous processes are froth separation and solvent extraction electrowinning, both of which processes are widely employed in the field of mining for the cost effective separation of minerals from their ores. While the mixers used in these and other substantially continuous industrial or commercial processes have traditionally been of the well-known electrically driven propeller type, recent concerns have surfaced over the energy consumption of such propeller mixers, and as to the actual mixing efficiency achieved thereby in large vessels. This latter concern should be readily apparent to those skilled in the art from an observation of the relative localized perturbation (and hence mixing) that is apparent around the perimeter of vessels having a relatively large diameter as compared to the diameter of the mixing head of the propeller mixer, and from a realization that the angular velocity (and hence shear forces) vary greatly as one moves radially outwardly from the centre of the mixing head of a propeller mixer towards it tip. As a result, an increasing need exists in the prior art for commercial scale process mixers which are more efficient than the conventional propeller type mixers conventionally used in such processes.

Accordingly, there has existed for a considerable period of time a longstanding need for more efficient mixing devices suitable for use in the mixing of liquids in large vessels on a commercial scale for carrying out industrial and commercial processes on a substantially continuous, non-batch, basis. One solution in this regard has been provided in the form of a non-propeller type mixer as shown in International Application Number PCT/CA02/00528 published on Oct. 24, 2002 under publication number WO 02/083280 A1, which application has as one of its co-inventors Mr. Gary Haughton, a co-inventor also named in the present application.

The Haughton PCT/CA02/00528 invention relates, inter alia, to a non-propeller type mixing apparatus for use with a vessel substantially centered about a longitudinal axis. The mixer has a generally circular (in plan outline) blade which has a central head axis, a first end and a second end spaced from the first end along the head axis. The blade preferably tapers in a frusto-conical manner from the first end to the second end. The mixing blade is mounted within the vessel for reciprocating longitudinal motion with the central head axis substantially coaxial to the longitudinal axis of the vessel, and means are provided for imparting said reciprocating longitudinal movement to the mixing head, said means preferably comprising a scotch yoke mechanism. The scotch yoke mechanism is operatively connected to the blade by a drive shaft, and the scotch yoke mechanism effects said reciprocating longitudinal movement of the blade in a controlled manner with particularly advantageous operating parameters for efficient mixing being disclosed in the subject application.

The present invention relates to improvements to non-propeller type mixers of the general type disclosed in PCT Patent Application Number PCT/CA02/00528. More particularly, and without limitation, such improvements include: improvements to the mixer which facilitate the quick installation and removal of the scotch yoke mechanism from atop the mixing vessel (for repair or replacement) whilst maintaining the central head axis substantially coaxial to the longitudinal axis of the vessel; improvements to the configuration of the mixing blade; improvements to the scotch yoke mechanism which facilitate its installation, service life, operation, reliability, and ease of service; and improvements which particularly adapt the mixer disclosed for use with closed vessels containing explosive or otherwise dangerous gases, such as sewage digesters, wherein the escape of such dangerous gases from the closed vessel must be minimized at all times.

There is thus disclosed according to one aspect of the present invention a mixing apparatus for use with a vessel having a contiguous sidewall substantially centered about and defining a longitudinal axis, the mixing apparatus having a base plate removably mountable atop the vessel, a table frame removably mountable atop the base plate and a housing removably mountable atop the table frame. The apparatus also features a mixing head comprising a generally annular blade body for immersion into the fluids to be mixed within the vessel, the blade body having a centrally positioned hub member defining a substantially vertically directed hub axis, said hub member being attached to and surrounded by a ring portion defining an orifice having a centre of symmetry. A drive shaft is provided for supporting the mixing head within the vessel and extending from the hub member to the housing. A reciprocating drive assembly is mounted substantially within the housing, the reciprocating drive assembly being operatively connectable to the drive shaft for imparting reciprocating longitudinal movement to the mixing head. A linear bearing assembly is mounted on the table frame in proximal relation to the housing, with the drive shaft operatively slidable within the linear bearing assembly. With this arrangement, the mixing apparatus is positioned atop the vessel with the drive shaft, hub axis and centre of symmetry all being substantially aligned with said longitudinal axis.

According to another aspect of the invention, the mixing apparatus is constructed with the housing having a housing base plate adjacent its lower end, the table frame having a top plate adjacent its upper end, and with the housing being mountable atop the top plate in removable contacting relation therewith. The housing also preferably has a removable front cover plate with the linear bearing assembly operably mountable on the top plate with its upper end protruding thereabove into the interior of the housing. The housing is constructed and otherwise adapted to be laterally slidable to remove the upper end of the linear bearing from within the interior of the housing when the front cover plate of the housing is removed and the drive shaft is operatively disconnected from the reciprocating drive assembly. Such lateral sliding of the housing is accommodated by means of an open-ended notch formed along a front edge of the housing base plate, with the open-ended notch being shaped and dimensioned to surroundingly receive the upper end of the linear bearing within the arms of said notch. Such lateral sliding of the housing simplifies assembly, disassembly and servicing of the mixing apparatus. It further allows for removal of the entire housing and drive components therein (i.e. the scotch yoke mechanism) for easy repair or quick replacement, thereby minimizing potential down time (and the associated significant economic loss) for the mixing vessel, which as indicated above, is typically utilized in large scale continuous processing systems.

According to yet a further aspect of the invention, the above mixing apparatus further comprises a screw jack assembly operatively interconnected between the housing and the table frame for mechanically assisting with the aforementioned lateral sliding of the housing.

According to yet a further aspect of the subject invention, the table frame preferably has a plurality of table legs and is removably mountable atop the base plate by means of said table legs. This feature also simplifies assembly, disassembly and servicing of the mixing apparatus and its associated components and sub-assemblies and allows the more service intensive components of the device (e.g. the reciprocating drive assembly) to be at a convenient height for access by service personnel without significant stooping or bending and consequential discomfort, distress or back injury.

According to a particularly advantageous aspect of the invention, the drive shaft is comprised of at least two sections being releasably interconnectable one to the other, being an upper drive shaft section and a lower drive shaft section, wherein the upper drive shaft section is dimensioned and otherwise adapted to extend from its operative connection with the reciprocating drive assembly through the linear bearing to a point of releasable interconnection with the lower drive shaft section, which point is, at all times of operation of the mixing apparatus, located above the base plate. The lower drive shaft section extends from the point of releasable interconnection with the upper drive shaft section through an aperture in the base plate to terminate at a point of connection with the hub member. A raised annular flange member is preferably mounted on the base plate in encircling relation to the aperture, and a lock means is provided for selectively interacting with the lower drive shaft member and the annular flange member to prevent longitudinal sliding of the lower drive shaft section relative to the annular flange member. This arrangement facilitates leaving the lower drive shaft section and the mixing head (attached to its lower end) suspended within the interior of the mixing vessel whilst the entire mixing apparatus thereabove (consisting primarily of the housing, the reciprocating drive components housed therein, and the table frame) can be removed from the top of the vessel, for easy repair or quick replacement without the need for a large lifting crane, as would otherwise be required to lift the entire mixing assembly out of and clear from the top the mixing vessel. Moreover, in applications involving sealed mixing vessels, this arrangement facilitates easy access for servicing to the seals or other components that are installed (as described more fully hereinbelow) adjacent to the base plate below the level of the top plate of the table frame.

According to yet a further aspect of the present invention the aforementioned seal is a substantially annular seal member mounted on the interior of the annular flange member for selective inflation to fill the void between the lower drive shaft section and the interior of the flange for selective sealing of the escape of gas from the interior of the vessel to atmosphere around said upper drive shaft section.

According to still a further aspect of the present invention as adapted for use with sealed vessels, a further gas sealing means is disclosed which comprises, in combination, the use of gas seals within the lower end of the linear bearing positioned in gas sealing relation to the upper drive shaft section, which linear bearing projects downwardly below the top plate of the table frame, an upper annular flange member mounted on the underside of the top plate in gas sealing relation to said top plate and in encircling relation to the lower end of the linear bearing, and a resilient rubber sleeve member extending from the lower annular flange member to the upper annular flange member, with the sleeve member being releasably connectable to both of said annular flanges in gas sealing encircling relation thereto.

Further aspects of the present invention relate to improvements in the design and construction of the scotch yoke type of reciprocating drive assembly preferably used in the subject mixing apparatus, in the manner of delivering lubrication to the key wear components of assembly, and to the design and construction of alternate forms of mixing heads for use as a component of the mixing apparatus.

These and other aspects, advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
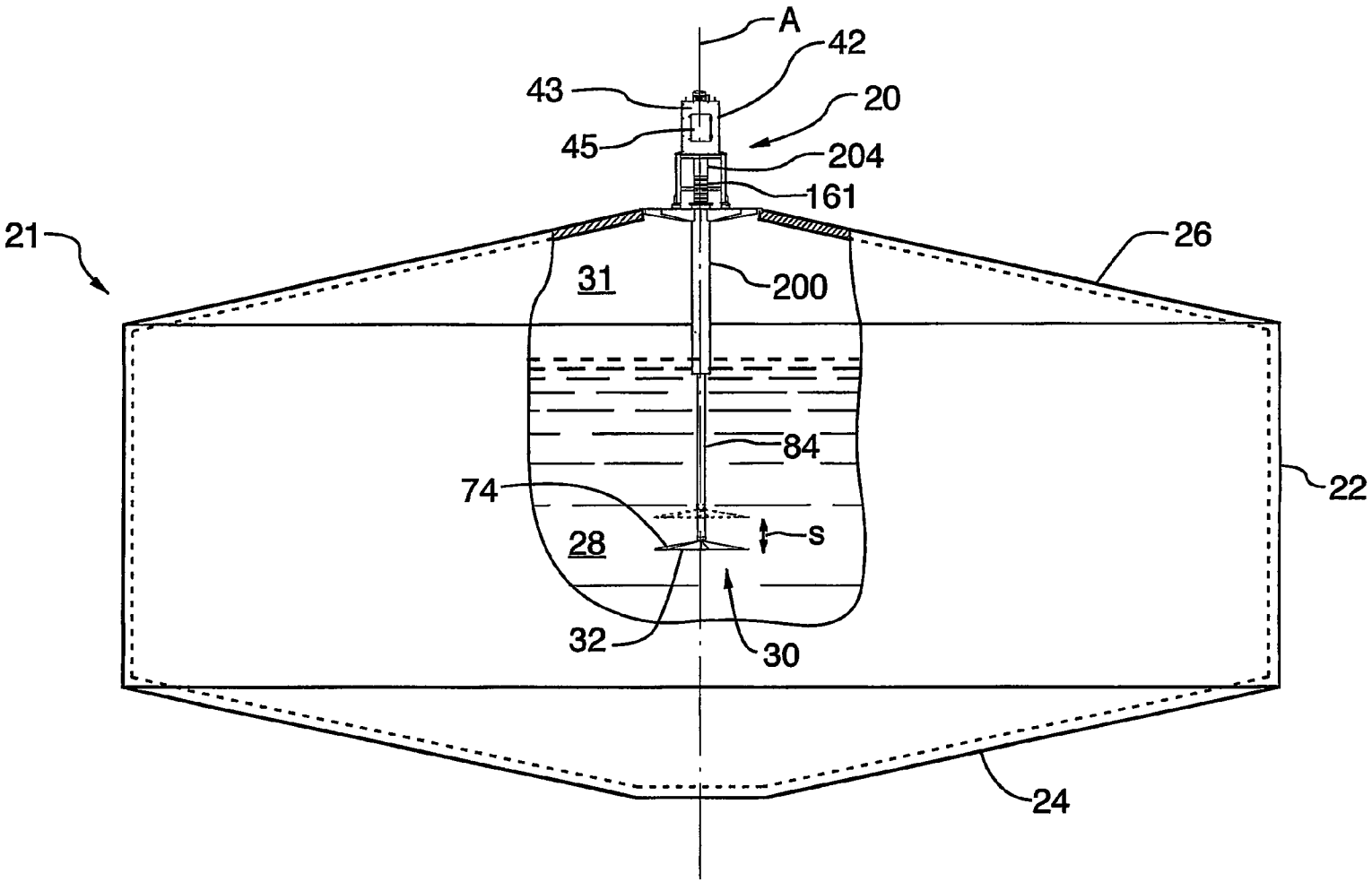
FIG. 1 is a front elevational view of a mixing apparatus according to a preferred embodiment of the invention shown installed atop a municipal sewage digester, with the tank of the digester partially cut away to illustrate portions of the invention not otherwise visible in such an installation.
Figure 2:
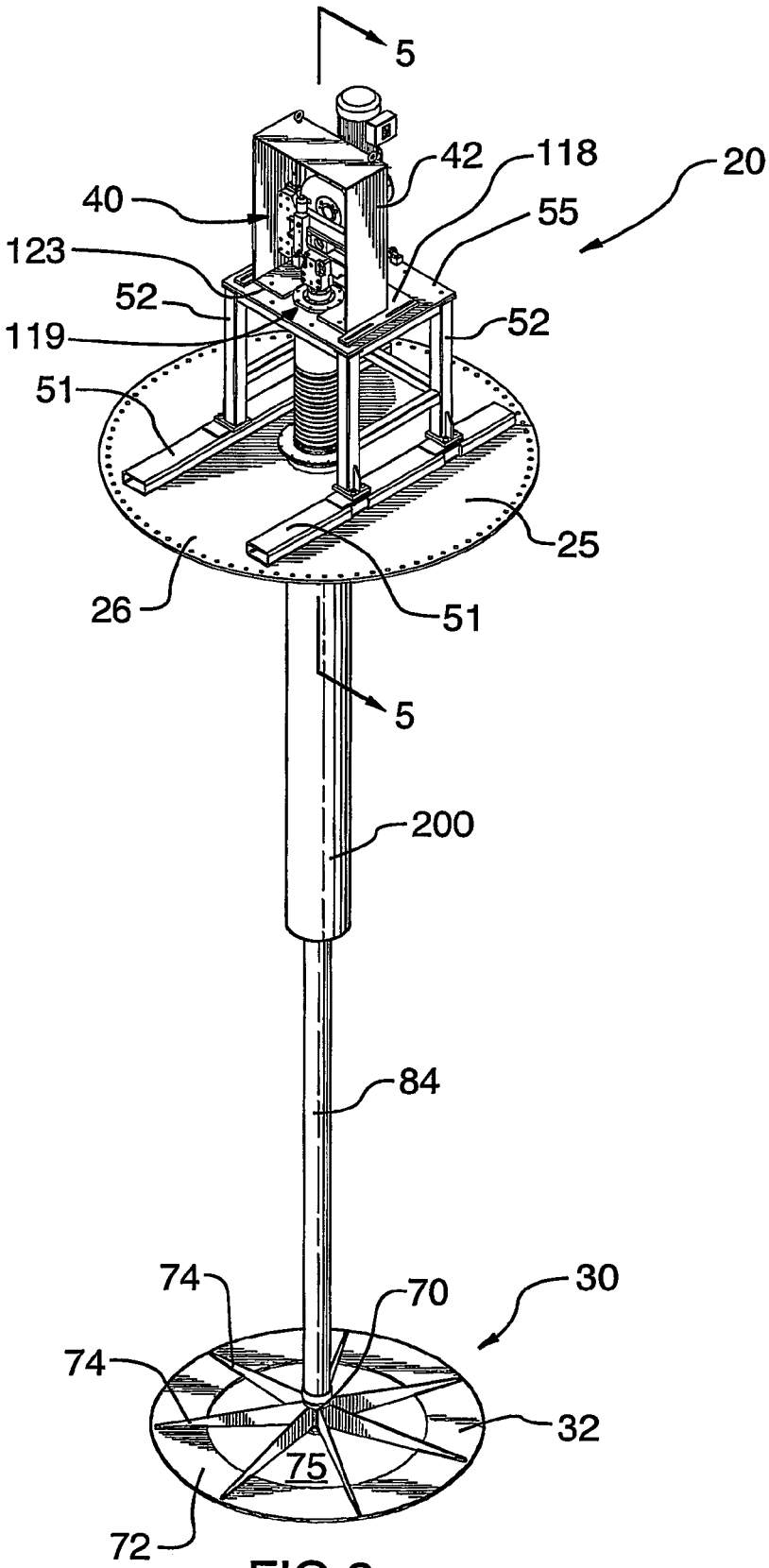
FIG. 2 is an enlarged perspective view from the top front of the mixing apparatus of FIG. 1.

Referring to FIG. 1 of the drawings there will be seen a mixing apparatus according to a preferred embodiment of the present invention generally designated by the reference numeral 20. The mixing apparatus has particular utility when used in association with a vessel 21 having a contiguous sidewall 22 which is centered about and defines a longitudinal axis designated by the reference letter "A". In the preferred embodiment shown, the vessel 21 is a sewage digester, which does not form part of the invention, and which is generally cylindrical. The illustrated vessel 21 has a concave bottom wall 24 and a generally congruent convex shaped top wall 26.

Municipal waste water digesters such as the vessel 21 are typically employed in municipal waste water treatment plants at a secondary, tertiary, or higher stage of treatment, such that the liquid waste 28 pumped into such a vessel 21 is relatively homogenous when it enters the vessel 21. The purpose of such digesters is to facilitate microbial or chemical breakdown (digestion) of the organic material contained in the liquid waste 28, which purpose is greatly facilitated by mixing or agitation of the liquid waste 28 within the interior 30 of the vessel 21. Traditionally, propeller type mixers (not shown) have been used for this purpose, but these have proven to be relatively inefficient in terms of their actual mixing efficiency (particularly in the regions adjacent to the sidewall 22 of the vessel 21), and in the power consumption required to achieve such mixing. For example, typical horsepower ratings in the range of 80-100 horsepower are required to facilitate adequate mixing for digestion by propeller-type mixers in a conventional municipal sewage waste digester of the general construction shown having a diameter of approximately between about 88-90 feet. In contrast, the applicant has found through in-field tests utilizing a mixing apparatus according to the present invention, that similar, or better, microbial digestion of the liquid waste 28 can be achieved in tanks of similar size whilst drawing only approximately 4.5-6.5 horsepower. This results in considerable energy savings to the operator of such municipal waste water treatment plants, particularly when it is considered that a typical municipal waste water treatment plant will have a plurality of digester vessels 21 of the generally type shown, with the exact number utilized depending upon the size of the plant. Moreover, such digesters are designed to operate on a substantially continuous flow basis, such that it is essential that all equipment used therewith, including the associated mixing apparatus, be robust, reliable, and easy to service or replace in a short turnaround time.

It should also be kept in mind that in municipal waste water digesters, as shown in FIG. 1, it is typical for potentially volatile gases, including without limitation methane (not shown), to collect during digestion at the top of the interior 31 of vessel 21 above the level of the liquid waste 28. Such gases, are not only potentially explosive, but are also potentially harmful to the environment and personnel working in the vicinity of the vessel 21. Accordingly, the vessel 21 shown in FIG. 1 is necessarily a sealed vessel, and appropriate means for sealing against gas escape must be incorporated into the mixing apparatus 20 if it is intended to be used in conjunction with such sealed vessels. Accordingly, such means for sealing against gas escape from around the components of the mixing apparatus 20 are disclosed and claimed herein, but it will be appreciated that such means are entirely optional, and need not be employed in non-sealed vessels (not shown) which are open to the atmosphere.

Turning generally to FIGS. 1 through 5, inclusive, it will be seen that a mixing apparatus 20 according to the invention comprises a base plate 25, which base plate is removably mountable atop the vessel 21 by means of bolts or other fasteners (not shown) which extend through apertures 26 passing through the top plate 25, which top plate 25 is preferably strengthened in its center section by means of radially extending support ribs 29 (see FIG. 5) extending thereunder. With a sealed vessel 21, it would be highly advisable to utilize a sealing gasket (not shown) in interposed relation between the base plate 25 and the underlying top wall 26 of the vessel 21, but such gasket is not part of the present invention.

The mixing apparatus 20 further comprises a table frame 50 removably mounted atop the base plate 25 by means of bolts 57 (see FIG. 9) extending through foot flanges 53 positioned at the base of each of the table legs 52. A pair of tubular leg mount brackets 51 may also advantageously be mounted atop the base plate 25 to accept a respective pair of the table foot flanges 53 in supported relation thereon, thereby to spread the loading of the legs 52 more evenly over the surface of the base plate 25, and so as to minimize the need for piercing said base plate 24, thereby enhancing it's gas sealing integrity. The table frame 50 has a top plate 55 mounted at it's upper end above the four table legs 52, so as to provide a surface on which a housing 60 may be removably mounted, as described more fully below.

The mixing apparatus 20 further comprises a mixing head generally designated by reference numeral 30, which mixing head itself comprises a generally annular blade body 32 for immersion for mixing into the liquid waste 28 to be mixed within the vessel 21, the blade body having a centrally positioned hub member 70 which defines a substantially vertically directed hub axis "B" (see, for example, FIGS. 5, 8 and 11D), which hub axis is substantially aligned, in use, with the longitudinal axis "A". The hub member 70 is attached to a ring portion 72 by means of a plurality of spokes 74 extending radially outwardly from the hub member 70, which spokes 74 are secured to the hub member 70 and the ring portion 72 by conventional fastening means, welding or the like. The ring portion 72 defines by its inner circumference an inner orifice 75, which orifice 75 has a centre of symmetry coincident in the embodiment shown in FIGS. 1 through 10 and in all of the remaining figures with the axis "B". Further details of the mixing head 30 are given below.

A drive shaft, designated by the general reference numeral 80, is provided in the form of a hollow tube for supporting the mixing head within the vessel 21, which drive shaft extends from a point of releasable connection with the hub member 70 upwardly into the housing 42 for releasable connection to the reciprocating drive assembly 40 substantially mounted therein in a manner more fully described below. In the preferred embodiment illustrated, the drive shaft 80 is itself comprised of two separate hollow tube sections, being an upper drive shaft section 82 and a lower drive shaft section 84, each being releasably interconnectable to the other in a manner more fully described below, or in any other operative manner. The drive shaft 80 need not be in two pieces; it could be a single piece; moreover, it could be in more than two pieces. However, greater utility in terms of ease of installation, servicing and disassembly flows from a multipart arrangement for the drive shaft 80, as will be appreciated to those skilled in the art after having read and considered this entire specification.

Figure 5:
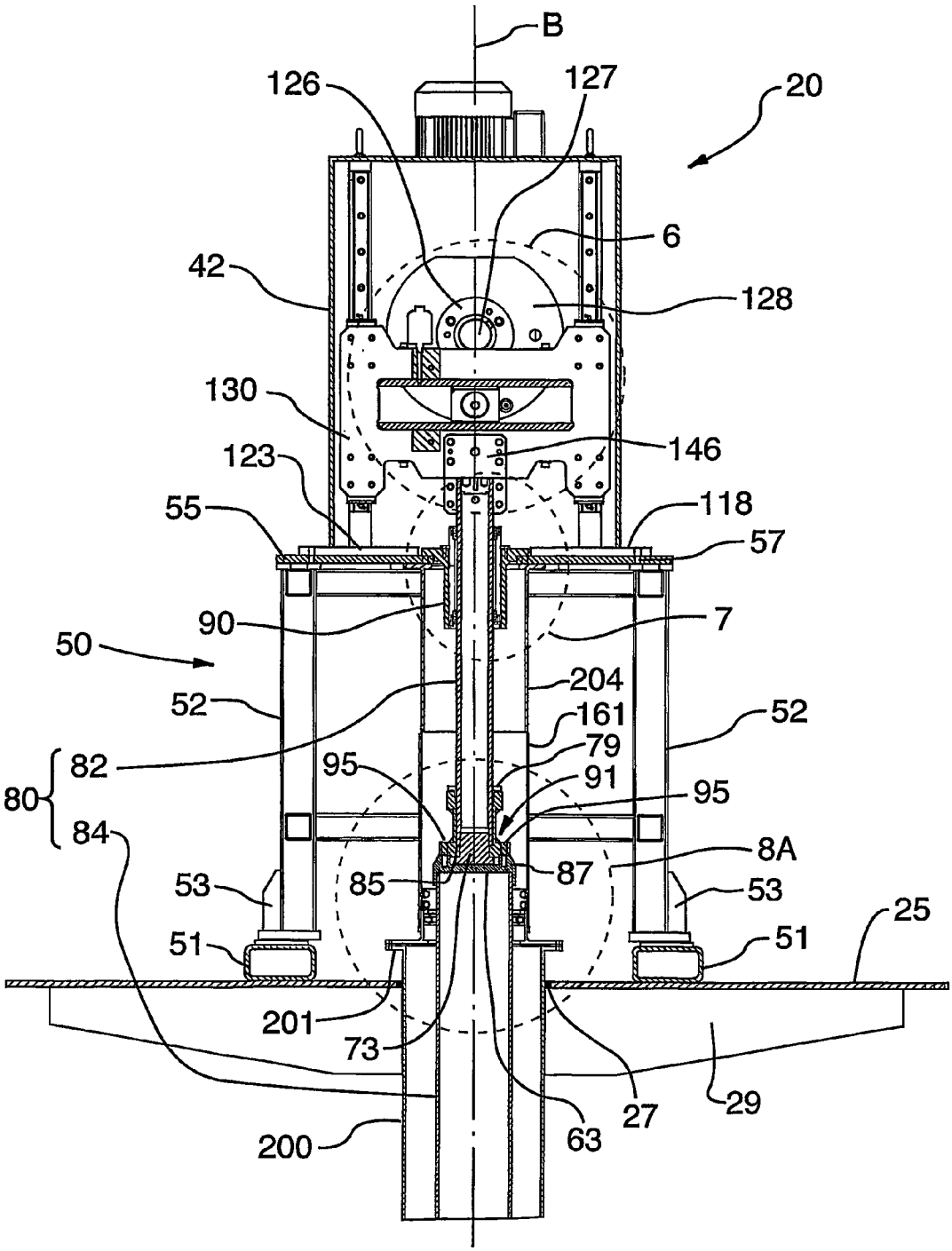
FIG. 5 is a sectional view of the mixing apparatus of FIG. 2 along sight line 5-5 thereof.
Figure 7:
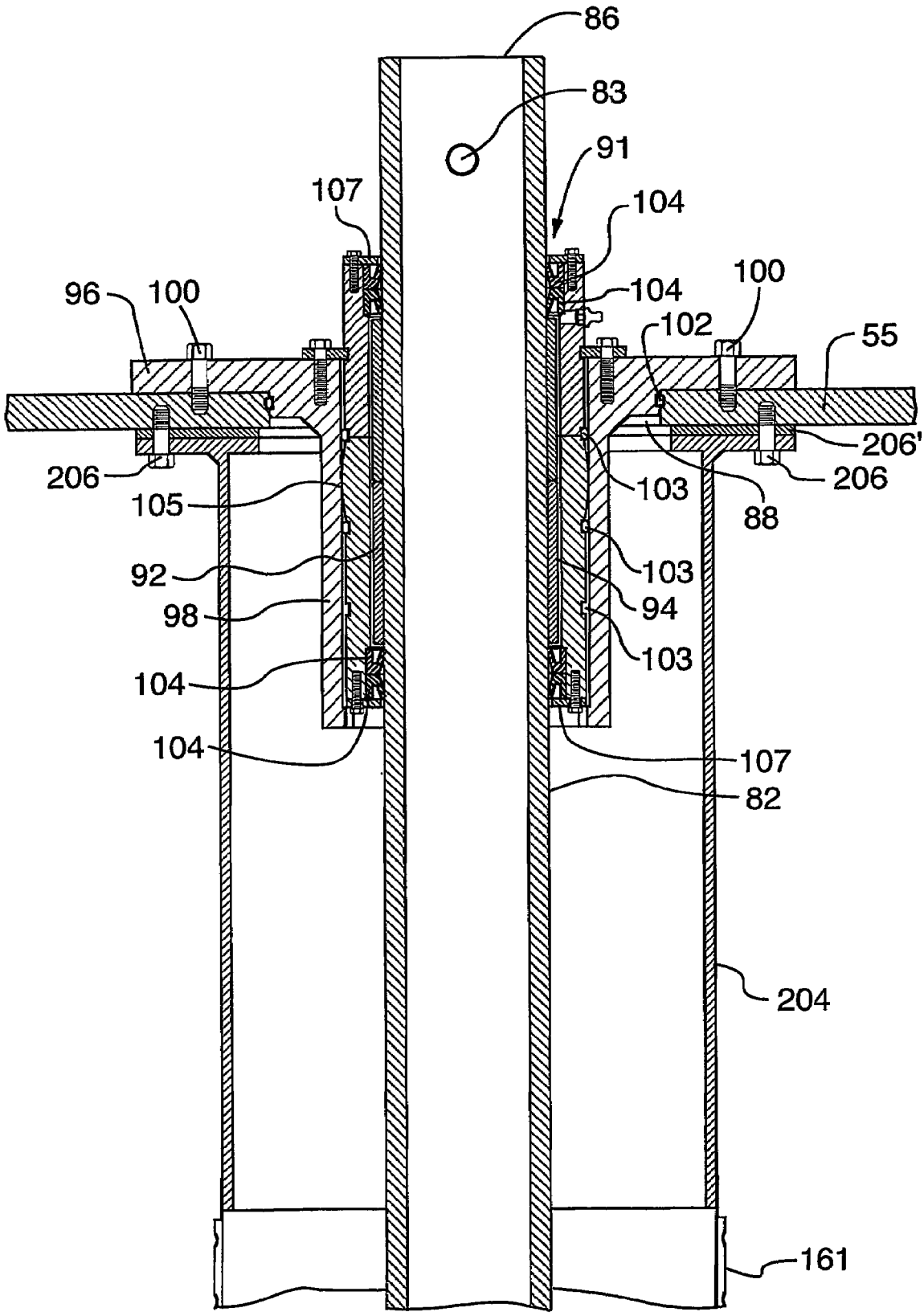
FIG. 7 is an enlarged view of the encircled area "7" of FIG. 5.
Figure 10:
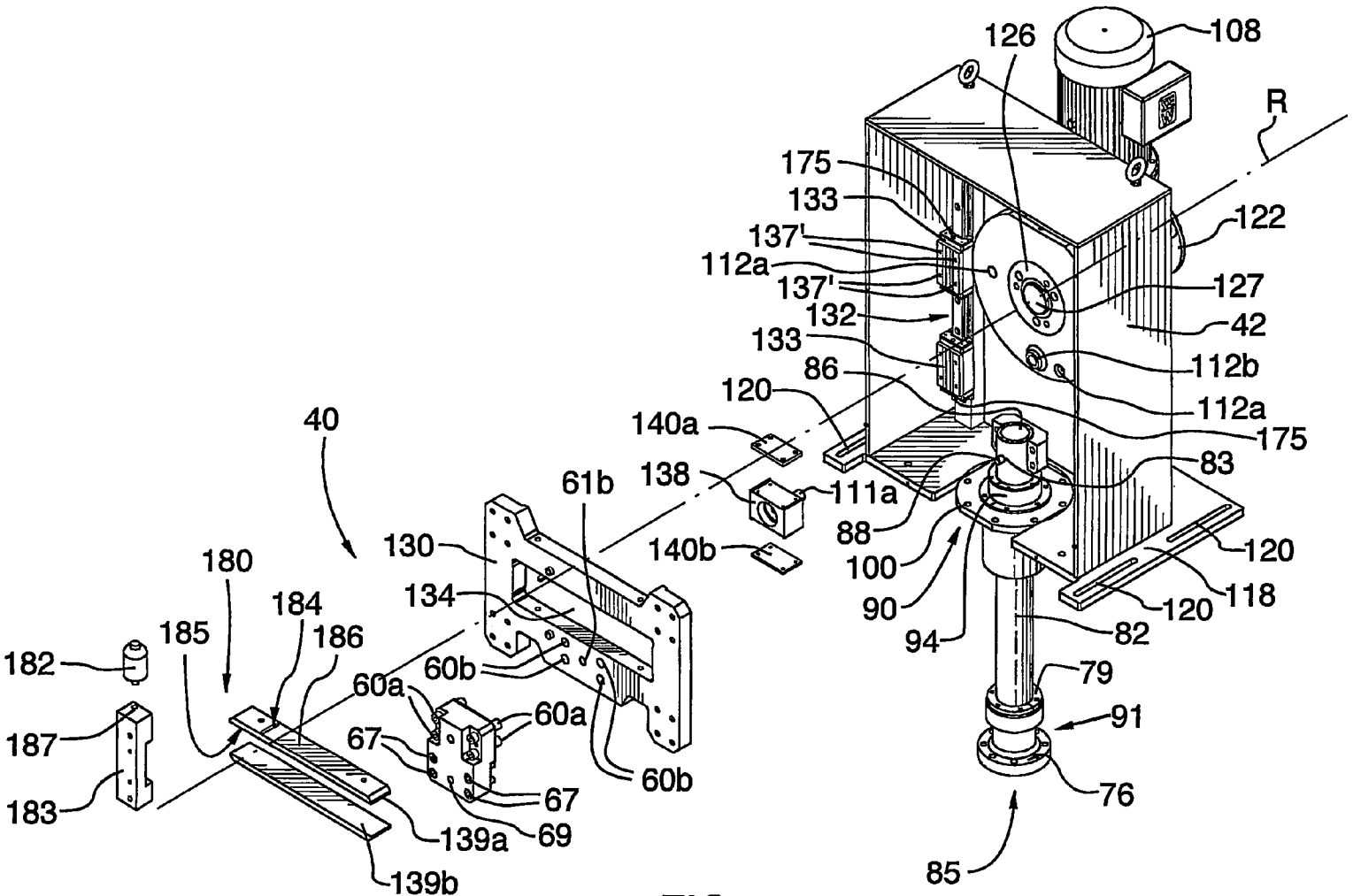
FIG. 10 is a partially exploded view of a portion of the apparatus of FIG. 9.
Figure 11A:
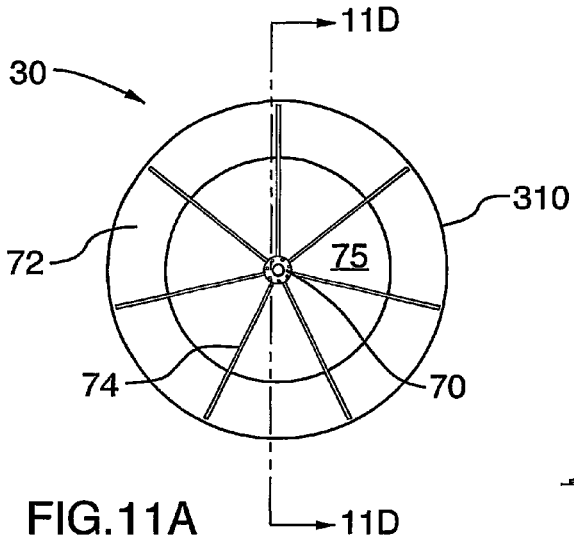
FIG. 11A is a top plan view of the mixing head shown in FIGS. 1-4.
Figure 11B:
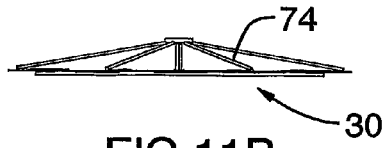
FIG. 11B is a side elevational view of the mixing head of FIG. 11A.
Figure 11C:
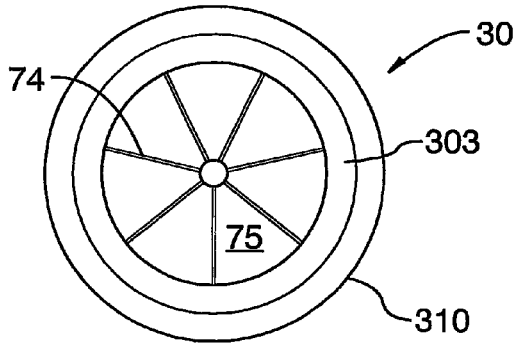
FIG. 11C is a bottom plan view of the mixing head of FIG. 11A.
Figure 11D:
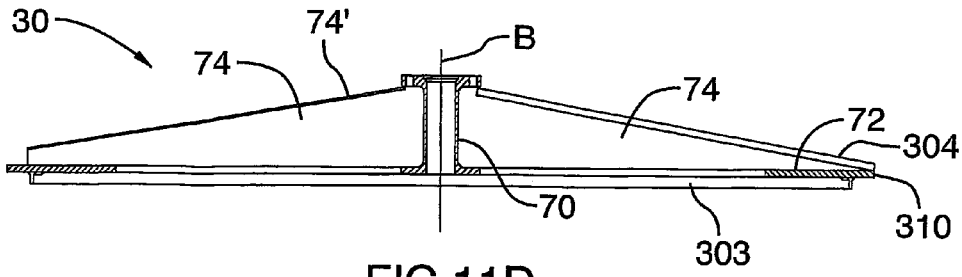
FIG. 11D is a sectional view along sight line 11D-11D of FIG. 11A.
Figures 11E, 11F:
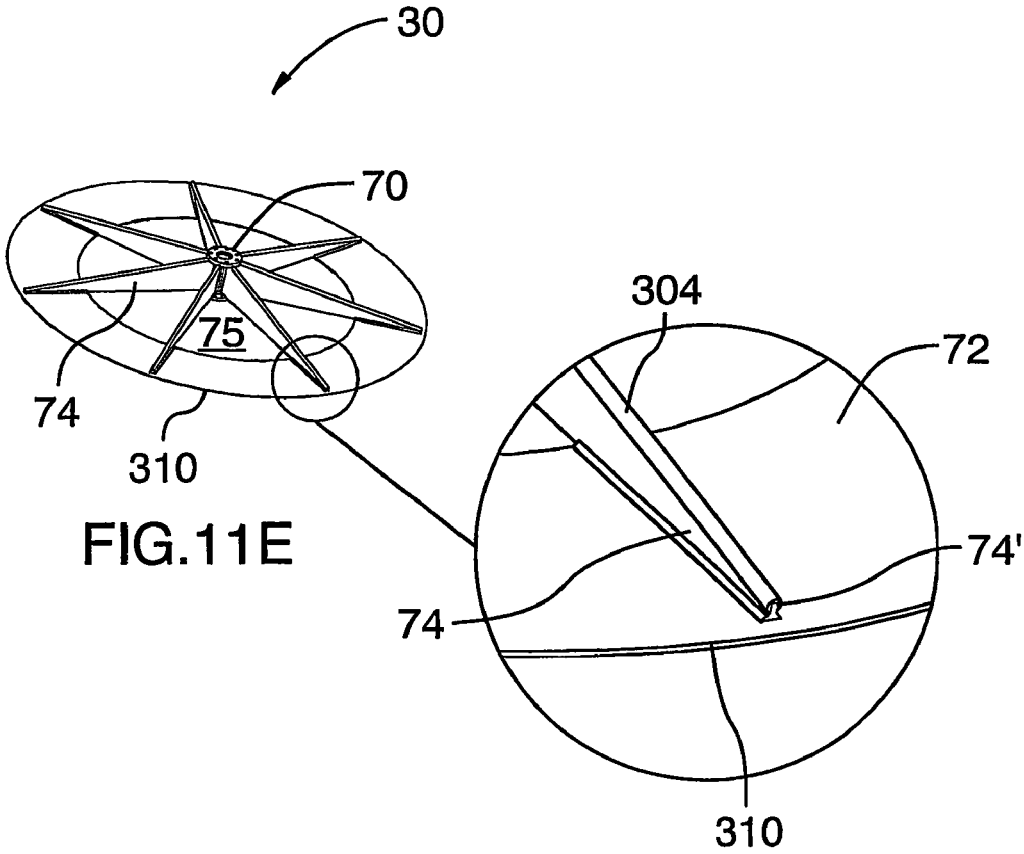
FIG. 11E is a perspective view of the mixing head of FIG. 11A.
FIG. 11F is a perspective view, on an enlarged scale, of the encircled area "11F" of FIG. 11E.
Figure 12A:
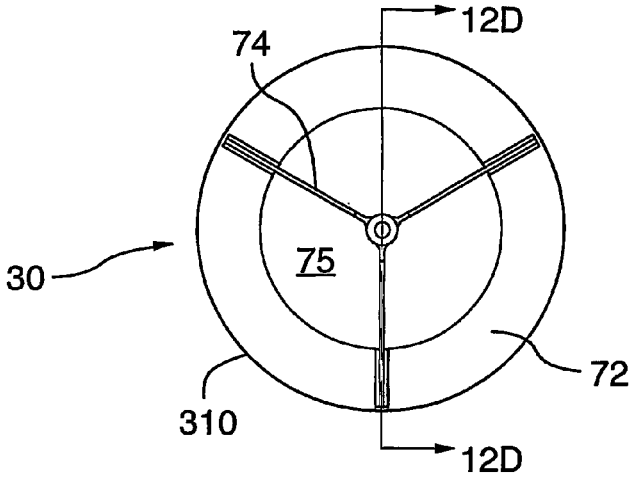
FIG. 12A is a top plan view of a first alternate embodiment of the mixing head for use with the mixing apparatus shown in FIGS. 1-10.
Figure 12B:
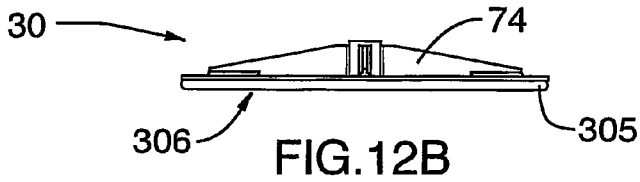
FIG. 12B is a side elevational view of the mixing head of FIG. 12A.
Figure 12C:
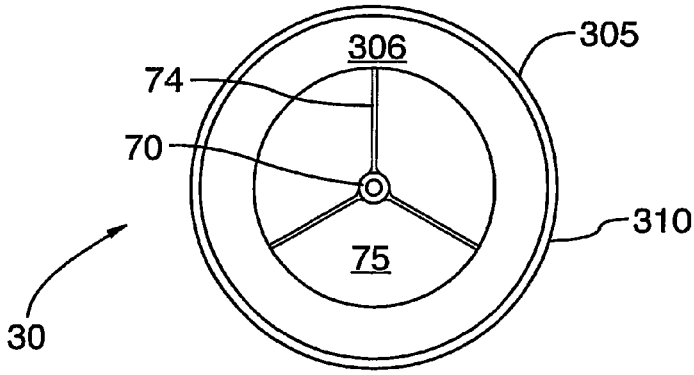
FIG. 12C is a bottom plan view of the mixing head of FIG. 12A.
Figure 12D:
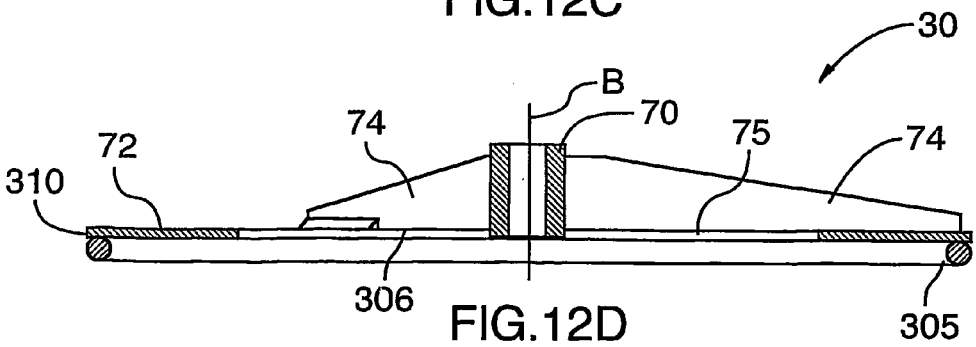
FIG. 12D is a sectional view along sight line 12D-12D of FIG. 12A.
Figure 13A:
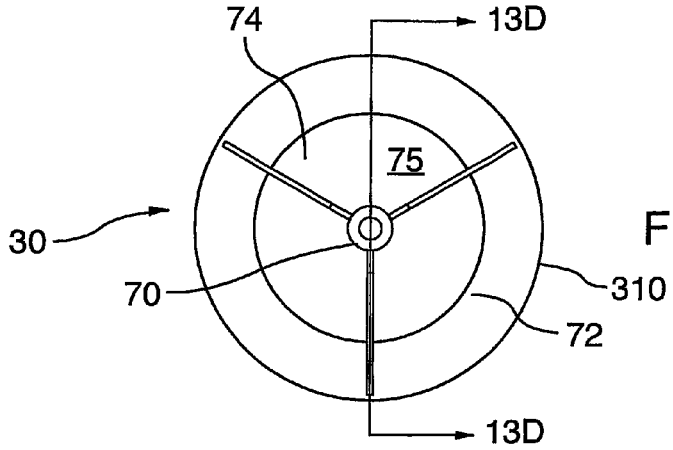
FIG. 13A is a top plan view of a second alternate embodiment of mixing head for use with the mixing apparatus shown in FIGS. 1-10.
Figure 13B:
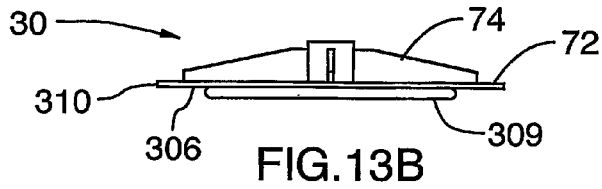
FIG. 13B is a side elevational view of the mixing head of FIG. 13D.
Figure 13C:
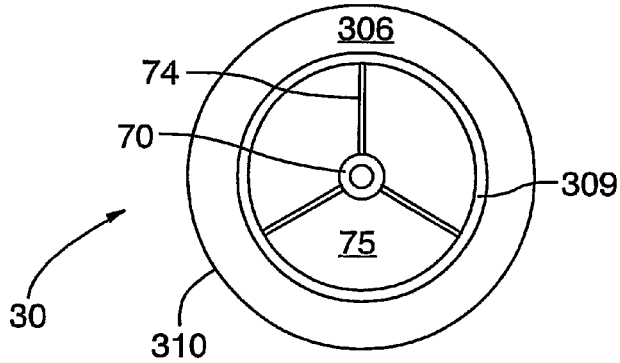
FIG. 13C is a bottom plan view of the mixing head of FIG. 13A.
Figure 13D:
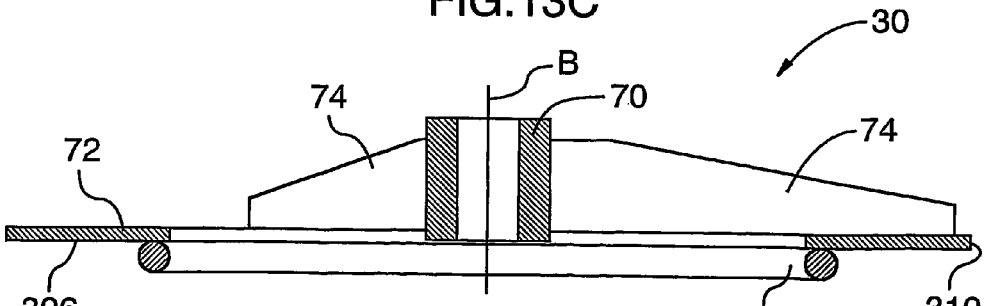
FIG. 13D is a sectional view along sight line 13D-13D of FIG. 13A.

As best seen in FIGS. 5, 7, and 10, the drive shaft 80 has a top end 86 disposed above the digester and extends therefrom, downwardly and substantially vertically, through an aperture 27 formed in the base plate 25 of the vessel 21 (see FIG. 5) to a terminus 71 (see FIG. 3A) bolted or otherwise removably connected to the hub member 70. The terminus 71 represents the point of releasable connection referenced in the previous paragraph.

As previously referenced, the drive shaft 80 includes an upper drive shaft section 82, which includes the top end 86 (see FIGS. 7 and 10), and a lower drive shaft section 84, which includes the terminus 71.

Figure 8A:
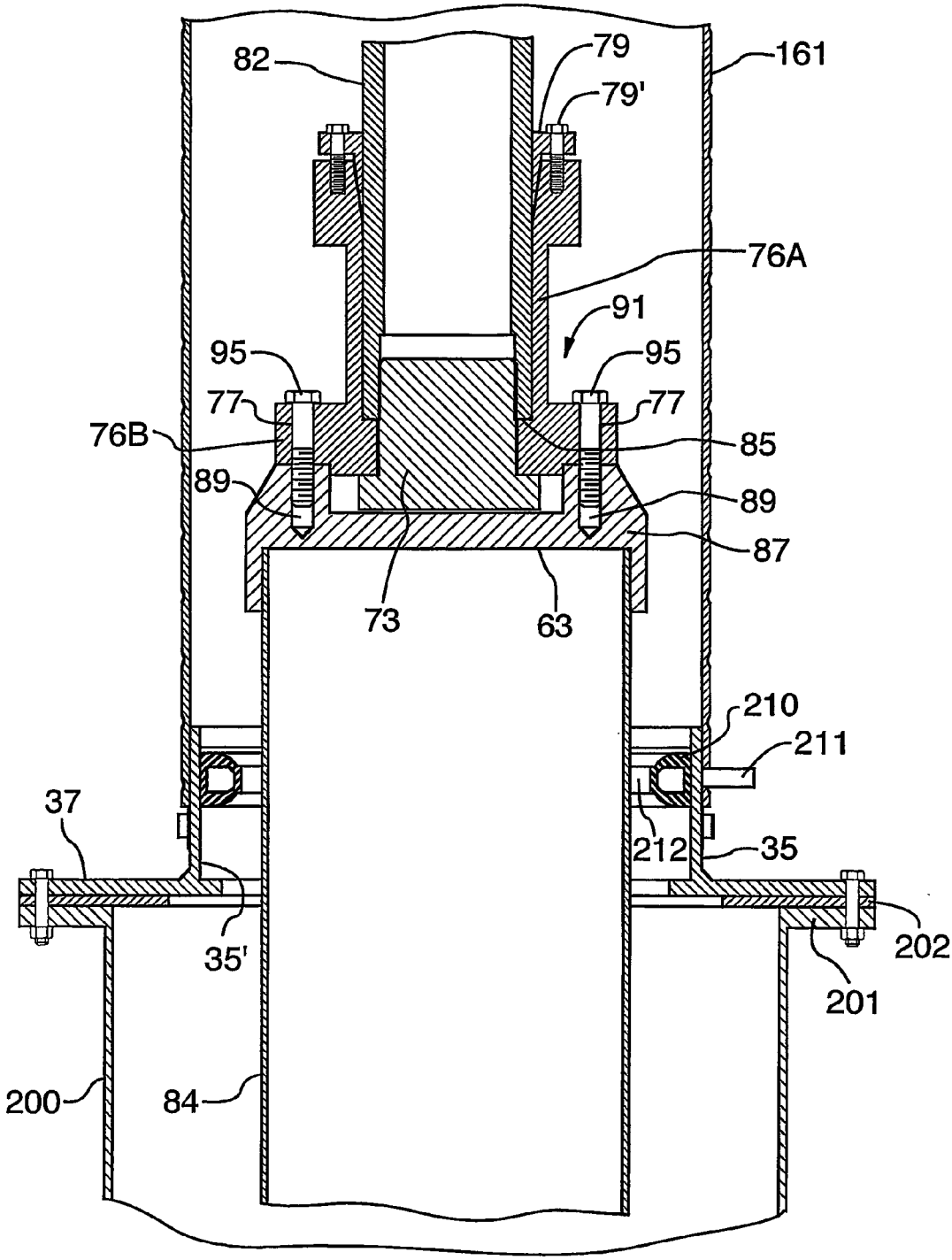
FIG. 8A is an enlarged view of the encircled area "8A" of FIG. 5 with an annular seal member deflated to permit linear reciprocation of the drive shaft.

The upper drive shaft section 82 is shown in detail in FIGS. 7, 8A and 10 and includes said top end 86 of the drive shaft 80, through which a dowel hole 83 is drilled, and a bottom end 85 which is threaded interiorly. A drive shaft mounting bracket 89 is tightly fit around the top end 86 of the drive shaft and has a complimentary reference hole (not numbered) positioned thereon for registry with the dowel hole 83. The dowel hole 83 is dimensioned to receive in frictionally retained relation a dowel pin 88 to prevent rotational movement of the top end 86 relative to the bracket 89. The drive shaft mounting bracket is shaped and otherwise dimensioned to mate with other components of the reciprocating drive assembly 40 to form a robust disconnectable assembly for imparting reciprocal longitudinal movement to the mixing head 30, as will be more fully described below.

As best seen in FIGS. 5 and 8A, the upper drive shaft section 82 has a connector assembly 91 removably attached to its lower end 85 for releasable connection to the lower drive shaft section 84. The terminal connection assembly 91 comprises: a split ring taper lock 79; a coupler member 76A disposed adjacent the bottom end 85 of the upper drive shaft section 82 beneath the taper lock 78, and connected thereto by machine bolts (not shown); and an end plug 73 threadingly engaging the inside diameter of the bottom end 85 of the upper drive shaft section 82. This arrangement firmly secures the coupler member 76A to the bottom end 60 of the upper drive shaft section 82 in removable relation thereto. The coupler member 76A further presents, adjacent its lower extremity, a peripheral flange portion 76B, having mounting bores 77 circumferentially spaced therearound.

The lower drive shaft section 84 has rigidly mounted at its upper end 63 a cap connector 87, said cap connector 87 having threaded bores 89 (see FIG. 8A) which are in alignment with the mounting bores 77 of the terminal connection assembly 91. Bolts 95 pass through the bores of the peripheral flange position 76B to engage the complementary threaded bores 89, thereby to releasably connect the cap connector 87 (of the lower drive shaft section 84) to the connector assembly 91. In this manner, the upper drive shaft section 82 and the lower drive shaft section 84 are releasably interconnectable one to the other.

The table frame 50 has operably mounted thereon atop its top plate 55 a linear bearing assembly 90, as best seen in FIGS. 7 and 10, in proximal relation to the housing 42, with the upper section 82 of the drive shaft 80 operatively slidable therewithin. The linear bearing assembly 90 has its upper end 91 protruding above the top plate 55, and includes a bearing housing 94 through which the upper section 82 of the drive shaft 80 extends, and which linear bearing assembly 90 is adapted to guide the said section 82 for reciprocating motion; a mounting flange portion 96 surrounding the bearing housing 94 and secured upon the top plate 55 by bolts 100, and a boss portion 98 dimensioned to fit within an aperture 88 in the top plate 55 in close-fitting relation and also surrounding the bearing housing 94. The actual linear bearing material 92 that makes linear sliding contact with the upper section 82 preferably has a low co-efficient of friction and is of conventional construction and composition, and forms a cylindrical sleeve that is press-fit into the bearing housing 94. The mounting flange portion 96 and the boss portion 98 are formed integrally. An O-ring 102 is disposed about the boss portion 98, so as to arrest gas flow through the aperture 88 about the linear bearing assembly 90. Further annular seals 104 are provided within the bearing housing 94. The annular seals 104 are positioned in pairs, in back-to-back relation, at both ends of the bearing housing 94, so as to preserve grease within the bearing housing 94, and so as to arrest gas exchange between the interior of the vessel and the ambient atmosphere. Seals 103 are also provided between bearing housing 94 and the integrally-formed boss portion 98 and mounting flange portion 96 to arrest gas flow. In this manner, the seals 103 and 104 are mounted within the liner bearing assembly 90 in encircling gas sealing relation to the upper drive shaft section 82. A pair of seal retaining rings 107,107 are positioned one each at opposite ends of the bearing housing 94 to releasably hold the annular seals 104,104 in place around the upper drive shaft section 82.

The bearing housing 94 is preferably of the self-aligning type, in that it includes a peripherally-extending arcuate ridge 105. This construction is advantageous, in that it permits the bearing housing 94 to shift slightly about ridge 105 in use, to accommodate off-centre loading of the reciprocating drive assembly 40, as may occur in use, and extends the life of the linear bearing material 92. Of course, when the bearing material 92 becomes worn, it may be removed and replaced, typically as a unit with the bearing housing 94.

The mixer housing 42 is comprised of a generally rectangular cabinet removably mountable atop the top plate 55 of the table frame 50 in enclosing relation to the top end 86 of the drive shaft 80. As seen in FIG. 1, the housing 42 preferably has a removable front cover plate 43, (which itself had a removable inspection plate 45, which plate can be easily opened for routine inspection and maintenance of the components of the reciprocating drive assembly 40 located therein). More involved maintenance will (including dismounting of the housing 42 from the table frame 50) require complete removal of the front cover plate 43, as described more fully below.

The housing 42 also has an overextending housing base plate 118 adjacent its lower end, as shown in FIGS. 2, 4, 9, and 10. The base plate 118 is provided with elongate slots 120 external to the housing 42, through which slots bolts (not shown) pass into the top plate 55, thereby securably mounting the housing 42 atop the top plate 55 of the table frame 50 in removable contacting relation as aforesaid.

Figure 4:
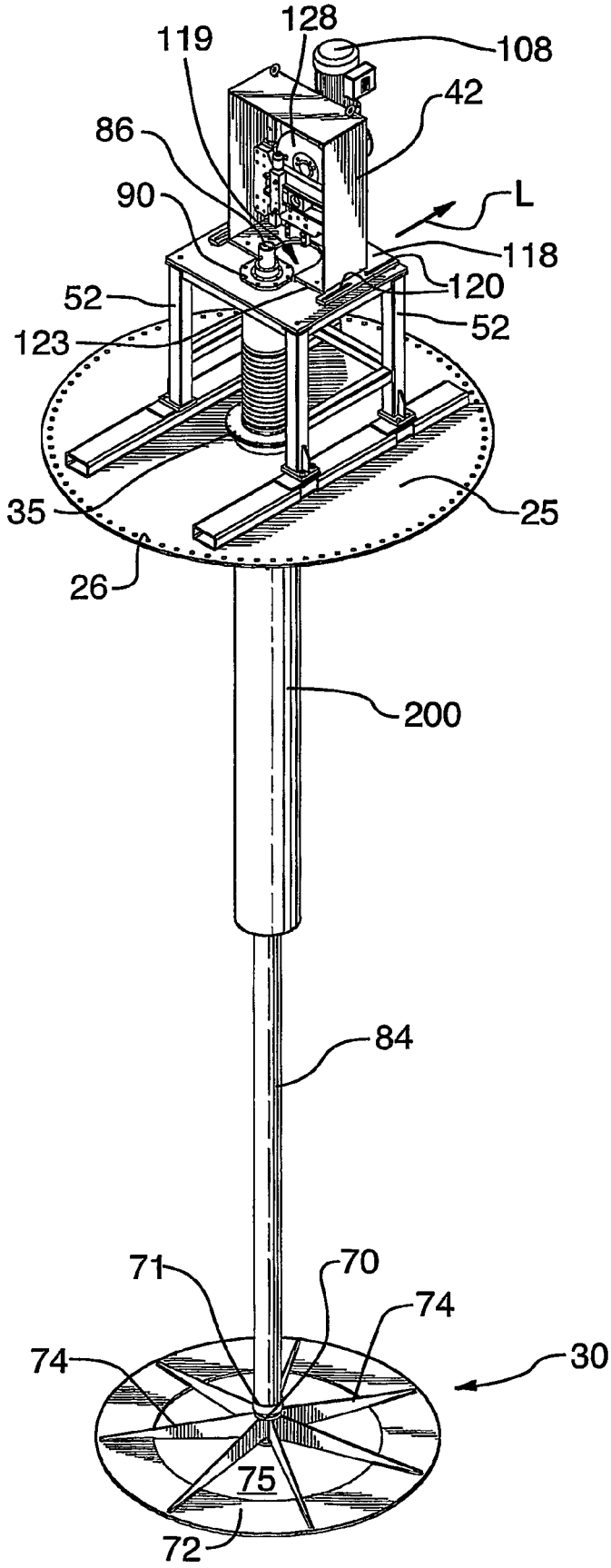
FIG. 4 is a perspective view similar to FIG. 2 with certain components of the device removed for ease of illustration and with the housing of the device laterally moved to facilitate servicing and/or disassembly of certain components of the mixing apparatus.

The housing base plate 118 further comprises an open-ended notch 119 originating along a front edge 123 of the housing base plate 118, which notch 119 is shaped and dimensioned (as illustrated) to surroundingly receive the upper end 91 of the linear bearing assembly 90 within the arms 125,125 of the notch. With this arrangement, when the cover plate 43 is removed from the housing 42, and the upper end 86 of the drive shaft 80 is operatively disconnected from the reciprocating drive assembly 40 (as described more fully below), the housing 42 is thereafter laterally slidable (as illustrated by arrow "L" in FIG. 4) to effect removal of the upper end 91 of the linear bearing assembly 90 from within its starting orientation within the interior of the housing 42 (as seen in, for example, FIGS. 2 and 9) to a subsequent orientation where the linear bearing assembly 90 is exterior to the housing, as seen in FIG. 4. This lateral movement allows quick and easy removal as a complete assembly of the components of the reciprocating drive mechanism 40 contained within the housing 42 from atop the table frame 50 for repair or replacement without having to disturb the drive shaft 80 subassembly mounted for reciprocating longitudinal sliding movement within the linear bearing assembly 90. This can considerably reduce down time of the vessel 21 and its associated costs and inconvenience.

Figure 3A:
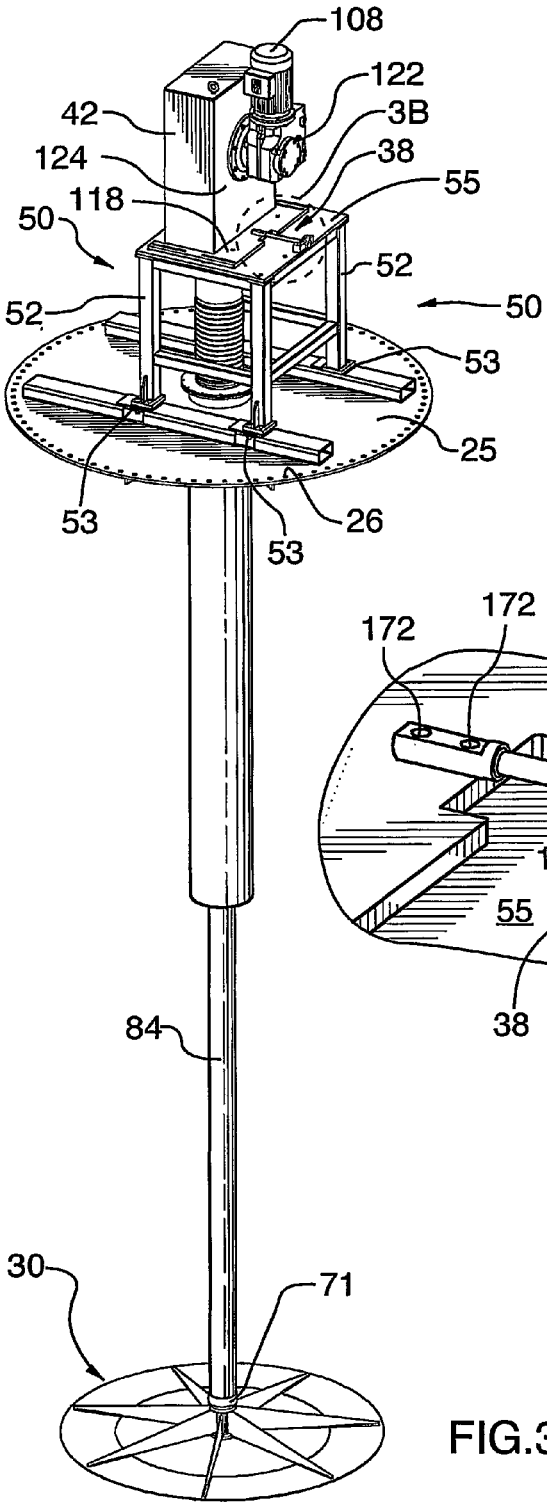
FIG. 3A is a top rear perspective view of the mixing apparatus of FIG. 2.
Figure 3B:
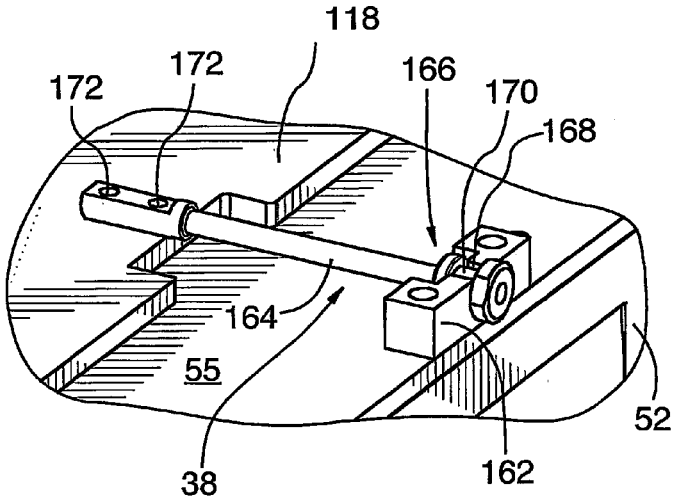
FIG. 3B is an enlarged view of the encircled portion 3B of FIG. 3A.

Such lateral sliding of the housing 42 can be greatly facilitated and a significant mechanical advantage can be achieved through the use of a screw jack assembly 38 operatively interconnected between the housing 42 and the top plate 55 of the table frame 50, as illustrated in FIGS. 3A and 3B. Such a screw jack assembly 38 includes a screw jack mount 162, a screw jack 164, and a jack nut 166. The screw jack mount 162 is mounted to the top plate 55 by bolts (not shown), and presents an upwardly-directed arcuate channel 168 in which is seated a waisted portion 170 of the jack nut 166. The screw jack 164, in turn, is threaded at one end into the jack nut 166 and has, at its opposite other end, a pair of anchoring bores 172 overlying a complimentary pair of threaded mounting sockets (not visible) formed in the housing base plate 118 to each accept a respective mounting bolt (not shown), thereby securing the opposite other end of the screw jack 164 to the housing 42. Tightening of the jack nut 166 causes the housing to be laterally pulled in the direction of arrow "L" of FIG. 4. For reasons of cost, the screw jack assembly 38 is constructed out of mild steel. In environments wherein such assembly 38 might be prone to corrosion, it may readily be unbolted and stored in a non-corrosive environment when not in use.

A drive motor 108, being, for example, an electric drive motor rated for between about 4 and 10 horsepower, is preferably mounted on the back of the housing 42 through the agency of a gear reduction unit 122, as seen in, for example, FIGS. 3A, 4, and 10. The gear reduction unit 122 has a conventional output shaft 127 which extends through a rear wall 124 of the housing 42 to drive the reciprocating drive assembly 40 mounted on the rear wall within the interior of the housing 42.

The reciprocating drive assembly 40 is preferably a so-called "scotch yoke" mechanism, such that the reference numeral 40 will hereafter be used to denote the scotch yoke mechanism. The scotch yoke mechanism 40 described is structurally and functionally similar in operation to that described in published PCT application Number PCT/CA02/00528, although certain refinements and improvements thereover are incorporated into the preferred embodiment disclosed and claimed herein. Thus, the scotch yoke 40 illustrated includes a flywheel hub 126 adapted to receive in rotatable driven relation the output shaft 127 of the gear reduction unit 122, and a flywheel 128 rigidly attached to the flywheel hub 126 for rotation therewith about a rotational axis "R" (as seen in FIG. 10) which axis extends substantially normal to the longitudinal axis "A".

As best seen in FIG. 10, the flywheel 128 has formed therein three radially spaced bores 112*a*, a selected one of which is in retained receipt of a crank pin mounting sleeve 112*b*. Selection of a specific one of the bores will vary the stroke length of the mixing head 30, which stroke length is depicted by arrow "S" in FIG. 1. Crank pin mounting sleeve 112*b* contains a centrally disposed socket for receiving in frictionally retained relation a crank pin 111*a*, which, when mounted in the socket, projects from the flywheel 128 in a direction substantially parallel to the rotational axis "R". The scotch yoke mechanism 40 further preferably includes, as illustrated, a wear plate block 138 having removable and replaceable upper 140*a* and lower 140*b* wear plates secured to its upper and lower surfaces, by counter-sunk screws (not shown), as best seen in FIG. 10. The upper 140*a* and lower 140*b* wear plates are preferably constructed from graphite impregnated bronze, or other similar bearing-like material having a low co-efficient of friction and good wear life. The wear plate block 138 has a central bore 142 formed therethrough which bore is adapted to receive the crank pin 111*a* in rotatable relation by means of an intermediate roller bearing 111*b*. The crank pin 111*a* is retained by the inner race (not shown) of the roller bearing 111*b*. The roller bearing 111*b* is retained in the central bore 142 with the assistance of a spring C-clip 117 (see FIG. 6). The crank pin mounting sleeve 112*b*, crank pin 111*a*, wear plate block 138, wear plates 140*a*, 140*b*, central bore 142 and intermediate roller bearing 111*b* combine together to form a crank member that projects from the flywheel 128 in a direction substantially parallel to the rotational axis With particular reference to FIGS. 6, 9, and 10, it will be seen that the scotch yoke assembly 40 further comprises a yoke slide 130, which is supported on the back wall 124 of the housing 42 for movement along a yoke axis "Y" (see FIG. 6), which yoke axis is disposed substantially parallel to the longitudinal axis "A". The yoke slide 130 is releasbly connected to the drive shaft 80 for imparting reciprocating longitudinal movement to the mixing heard 30 along the hub axis "B" during movement of the yoke slide 130 along the yoke axis "Y" as described more fully below.

First and second guide assemblies, each being a respective linear slide assembly 132, 134 are mounted on the rear wall 124 in laterally spaced relation to one another and in parallel relation to the yoke axis "Y" by means of counter-sunk machine screws 135. The guide assemblies each comprise a respective track slide 132',134', with each track slide having a pair of slide bogies 133,133 and 133',133' respectively retained on the track slides 132', 134' for operative sliding engagement along a pair of guide axes "GA1" and "GA2" (see FIG. 6) extending substantially parallel to the yoke axis "Y". The slide bogies are each removably attached to the underside of the yoke slide by means of four machine screws 137 which pass through the body of the yoke slide 130 and into four correspondingly placed and treaded bores 137' formed on the upper surface of each of the slide bogies 133, 133, 133',133' (see FIG. 10). In this manner, the yoke slide 130 is substantially disposed between the first 132 and second 134 guide assemblies for sliding engagement therewith along a pair of guide axes GA1, GA2 extending substantially parallel to the yoke axis "Y".

Figure 6:
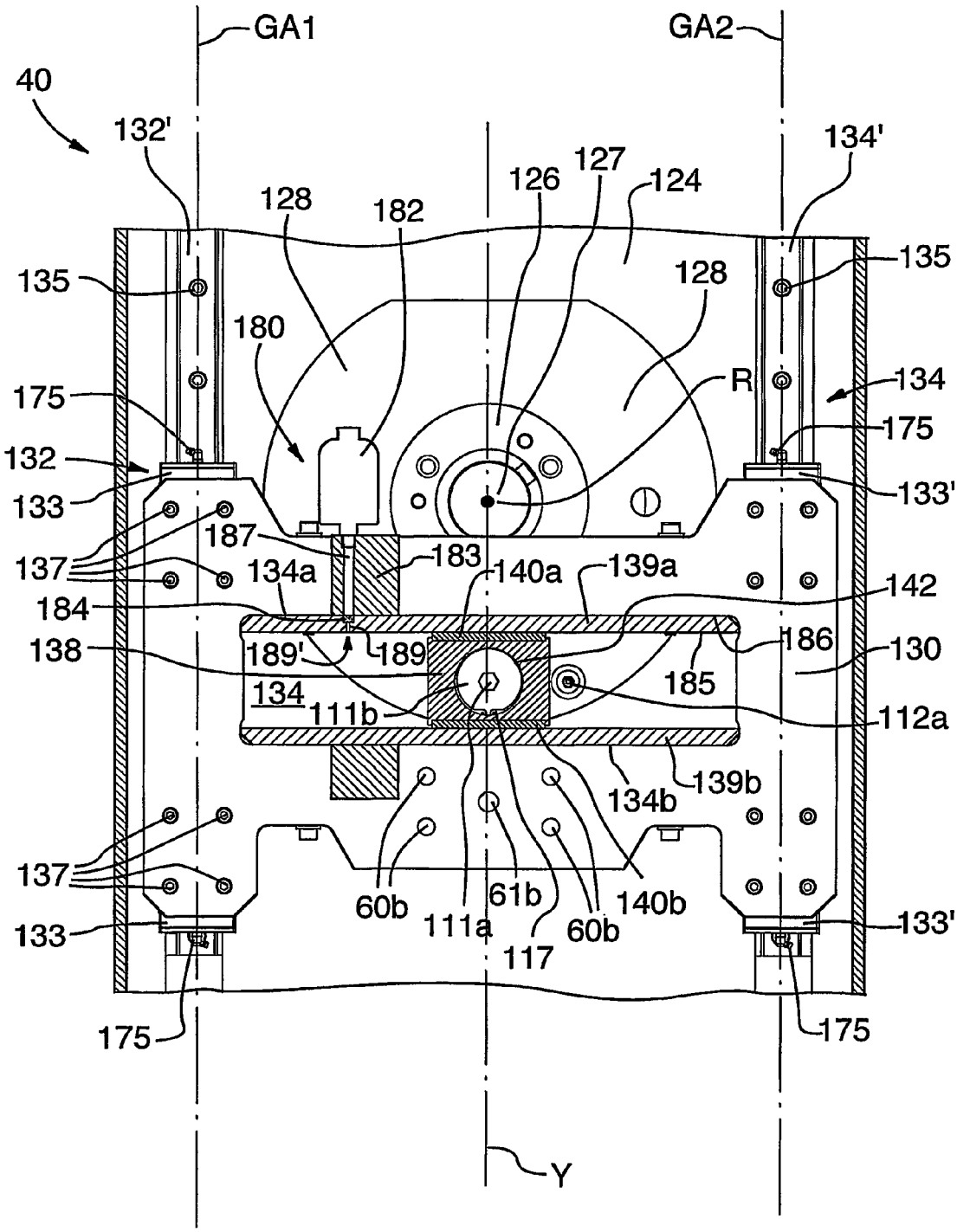
FIG. 6 is an enlarged view of the encircled area "6" of FIG. 5.

A means for providing lubrication to each of the linear slide assemblies 132,134 is preferably provided as best seen in FIGS. 6 and 10. Such means comprises a grease nipple 175 positioned one each on an exposed longitudinal end of each one of the slide bogies 133,133,133',133', which nipple is in fluid communication with a grease channel (not shown) extending from the grease nipple 175 through the body of the respective slide bogie to a grease port positioned on the underside of each slide bogie 133,133,133',133' in overlying relation to its respective track slide 132',134'. In this manner, the grease port is in fluid communication with the grease nipple 175 to selectively accept lubricating grease for distribution through said grease channel onto the respective one of the track slides 132',134' as said yoke slide 130 moves along the yoke axis "Y" as aforesaid.

With specific reference to FIGS. 6 and 10, it will be seen that the yoke slide 130 has a substantially linear race 134 formed therein, with the opposed upper 134*a* and lower 134*b* surfaces thereof each being clad with a respective upper 139*a* and lower 139*b* bearing plate removably fastened thereto by means of countersunk machine screws, or the like (not shown). The upper 139*a* and lower 139*b* bearing plates are oriented with the planes defined by each oriented substantially normal to both the rotational axis "R" and to the yoke axis "Y". Mover, both bearing plates 139*a* and 139*b* are preferably constructed from a frictionally wear-resistant material, such as hardened steel. The upper 139*a* bearing plate is preferably dimensioned to be slightly wider than the overlying upper 134*a* surface of the linear race 134 so as to form a protruding font ledge portion (best seen in FIG. 9), whose purpose will become apparent below.

With the above arrangement, the bore 142 of the wear plate block 138 operatively receives the crank member in rotatable driving relation, and the wear plate block 138 is mounted for constrained substantially horizontal sliding movement between the upper 140*a* and lower 140*b* wear plates, which wear plates are in turn in frictional sliding contact with a respective one of the upper 139*a* and lower 139*b* bearing plates. Such movement, of course, will in time cause wear of wear plates 140*a*, 140*b*, whereupon new wear plates may be substituted.

In the preferred embodiment illustrated, a means for lubricating the surface of at least one of the upper 139*a* and lower 139*b* bearing plates (and consequently the upper 140*a* and lower 140*b* wear plates) is advantageously provided in order to prolong the service life of the scotch yoke assembly 40 and potentially lessen the time between bearing plate 139*a*, 139*b* or wear plate 140*a*, 140*b* maintenance and/or replacement. This means can be best seen and understood with reference to FIGS. 6 and 10, wherein it has been assigned the general reference numeral 180. This means for lubrication 180 comprises an oil storage reservoir 182 which is advantageously filled periodically as necessary with a relatively light machine oil (not shown), and which reservoir 182 is mounted, by means of a removable "C"-shaped bracket member 183, onto the yoke slide 130 at a position above the level of the upper bearing plate 139*a* so as to have the assistance of gravity in oil delivery to the bearing plate 139*a*. An oil flow control means, in the form of a felt pad 184, is positioned between the oil reservoir and the operative contacting (i.e. lower) surface of the upper bearing plate 139*a*. As shown, the felt pad 184 sits in a fitted cavity formed for such purpose on the upper surface 186 of the upper bearing plate 139*a*, partially extending onto the projecting ledge portion thereof previously described. The reservoir 180 is in fluid communication with the oil flow control means 184 by way of a channel 187 formed in the "C"-shaped bracket member 183, which channel 187, when the yoke slide 130 is assembled as shown, is positioned in overlying relation to at least that portion of the felt pad 184 extending onto said projecting ledge. An oil delivery channel 187 extends from the bottom of the fitted cavity underlying the felt pad 184 through the body of the upper bearing plate 139*a* to connect with and terminate at an oil delivery port 189' positioned on the operative contacting surface 185 of the upper bearing plate 139*a*. With this arrangement, oil is able to make its way, under the influence of gravity, from the oil storage reservoir 180, through the channel 187 in the "C"-shaped bracket member 183, and thence on to saturate the felt pad 184. Once the felt pad 184 becomes saturated, the oil will travel therefrom (in a controlled manner influenced by gravity and the wicking effect of the felt) through the delivery channel 189 to exit in a slow dripping fashion from the delivery port 189' onto the surface of the upper bearing plate 139*a*. Spreading of the oil beyond the immediate area of the delivery port 189' across the operative contacting surface 185. (and, for that matter, across the upper wear plate 140*a*) will be assisted by the reciprocating sliding movement of the wear block 138 past the port 189' upon rotation of the flywheel 128 as described more fully below. While but a single oil storage reservoir 180 feeding oil to the upper bearing plate 139*a* and upper wear plate 140*a* (only) is shown for ease of illustration, it will be readily apparent to those skilled in art that lubricating oil can similarly be delivered to the lower bearing plate 139*b* and lower wear plate 140*b* by the provision of analogous structures to those disclosed above, such structures being similarly configured in association with the lower bearing plate 139*b* and lower wear plate 140*b*.

In operation, rotation of the output shaft 127 by energization of the electric motor 108 causes concurrent rotation of the flywheel hub 126 and the attached flywheel 128. Such motion of the flywheel 128, of course, causes rotation of the crank pin 111*a* seated in the socket 112*b* of the flywheel 128. Such motion of the crank pin 111*a*, in turn, imparts reciprocating horizontal motion of the wear plate block 138 (with attached upper 140*a* and lower 140*b* wear plates) relative to the race 134 of the yoke slide 130 (between upper 139*a* and lower 139*b* bearing plates), and concurrent reciprocating vertical motion of the yoke slide 130 along the first 132 and second 134 linear slide assemblies in parallel relation to the yoke axis "Y".

Figure 9:
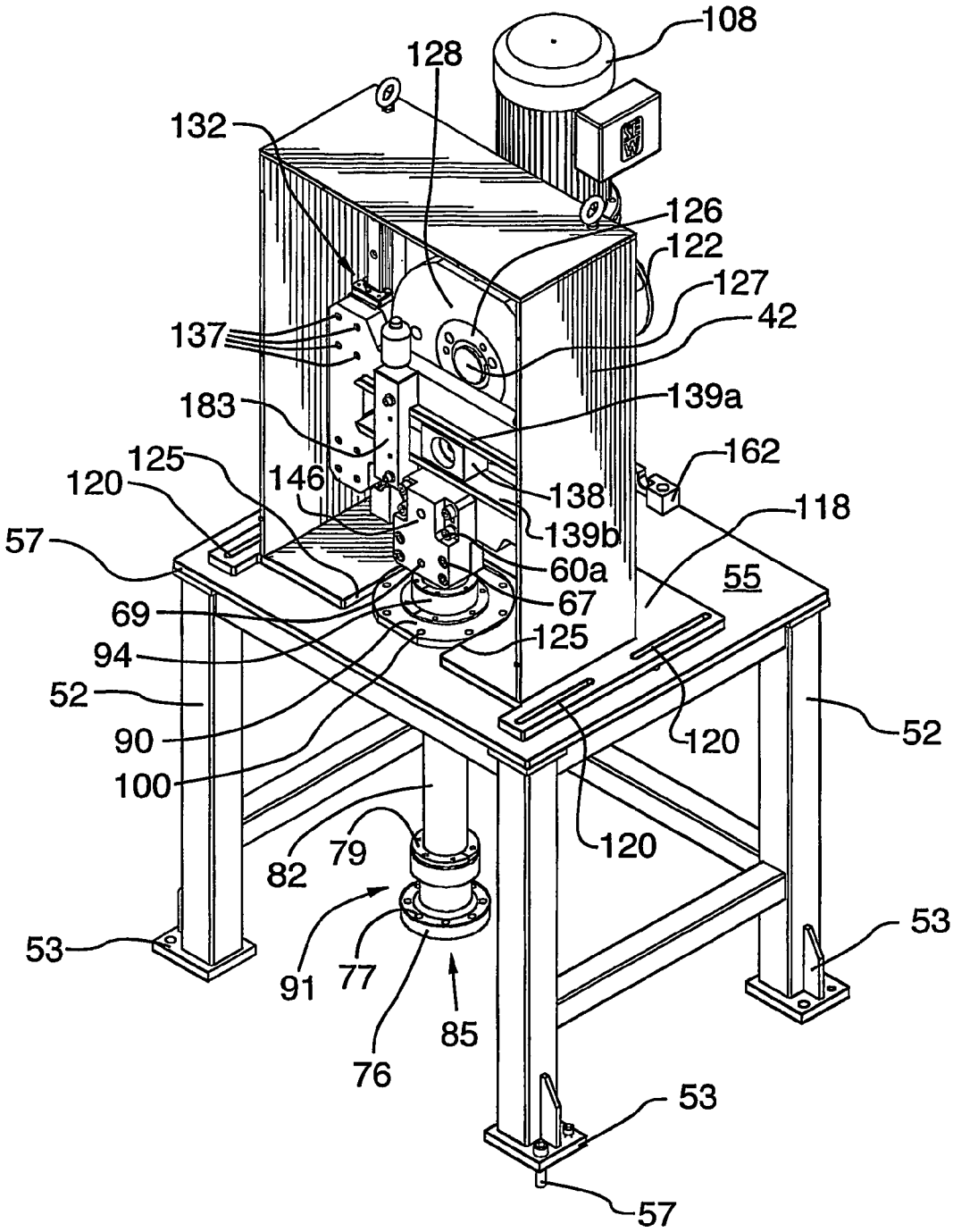
FIG. 9 is an enlarged perspective view from the top right of a portion of the preferred embodiment of mixing apparatus of FIGS. 1 through 8, with certain components removed for ease of illustration.

Such reciprocating vertical motion of the yoke slide 130 is imparted to the upper section 82 of the drive shaft 80 by means of the drive shaft mounting bracket 89 fitted to the top end 86 of the drive shaft 80 (see FIG. 10) which bracket 89 is rigidly attached to a shaft clamp bracket 146, as seen in FIG. 9. The dowel pin 88 extending from the dowel hole 83 also extends into a complimentary dowel hole 69 in the clamp bracket 146, and the clamp bracket is bolted to the mounting bracket 89 in rigid, close-fitting relation by means of four mounting bolts 67 passing through the body of the clamp bracket 146 into the side flanges of the drive shaft mounting bracket 89, as best seen in FIG. 10. The shaft clamp bracket 146 is, in turn, rigidly attached to the yoke slide 130 by means of four mounting bolts 60*a*, the rigidity of which attachment is assisted by insertion of a second dowel pin (not shown) in mating dowel sockets 61*a* and 61*b* formed in each of the clamp bracket 146 and the yoke slide 130.

As particularly visible in FIGS. 5 and 8A, a draught tube 200 extends downwardly from a terminal flange 201 positioned above the base plate 25 to be immersed in the liquid waste 28, as seen in FIG. 1. Such immersion tends to minimize the volume of gas that finds its way from the interior 31 of the vessel 21 up the draught tube through the aperture 27 in the base plate 25. Nonetheless, a sealing means is still required for substantially preventing gasses formed in the vessel 21 above the level of the liquid waste 28 from leaking to atmosphere in undesirable quantities. To this end, such gas sealing means preferably comprises a raised annular flange member 35 mounted atop the terminal flange 201 in encircling relation to the aperture 27 (see FIG. 5) formed in the base plate 25. The raised annular flange member 35 includes an annular base ring 37 that is bolted to the top of the terminal flange 201 in surrounding relation to the aperture 27, as best seen in FIGS. 5 and 8A, with an intervening sealing gasket 202 interposed therebetween to seal against gas escape.

With specific reference to FIGS. 5 and 7, the gas sealing means further comprises an upper annular flange member 204 mounted to the underside of the top plate 55 of the table frame 50 in encircling relation to the lower end of the linear bearing assembly 90 by bolts 206. A resilient gasket 206 is preferably interposed between the upper annular flange member 204 and the underside of the top plate 55 to facilitate gas-sealing mounting of the upper annular flange member 204 against the top plate 55. The gas sealing means further comprises, as discussed above the seals 104 positioned within the linear bearing assembly 90, and a sleeve member 161 (preferably in the form of a corrugated, bellows-style tube member) constructed from resilient rubber material. The sleeve member 161 has open ends which are resiliently mounted in gas-sealing removable relation, about each of the raised annular flange member 35 and the upper annular flange member 204, respectively. With this arrangement, the components of the gas sealing means described in the last two paragraphs substantially prevent gasses formed in the vessel 21 above the level of the waste liquid 28 in the vessel 21 from escaping to atmosphere.

Figure 8B:
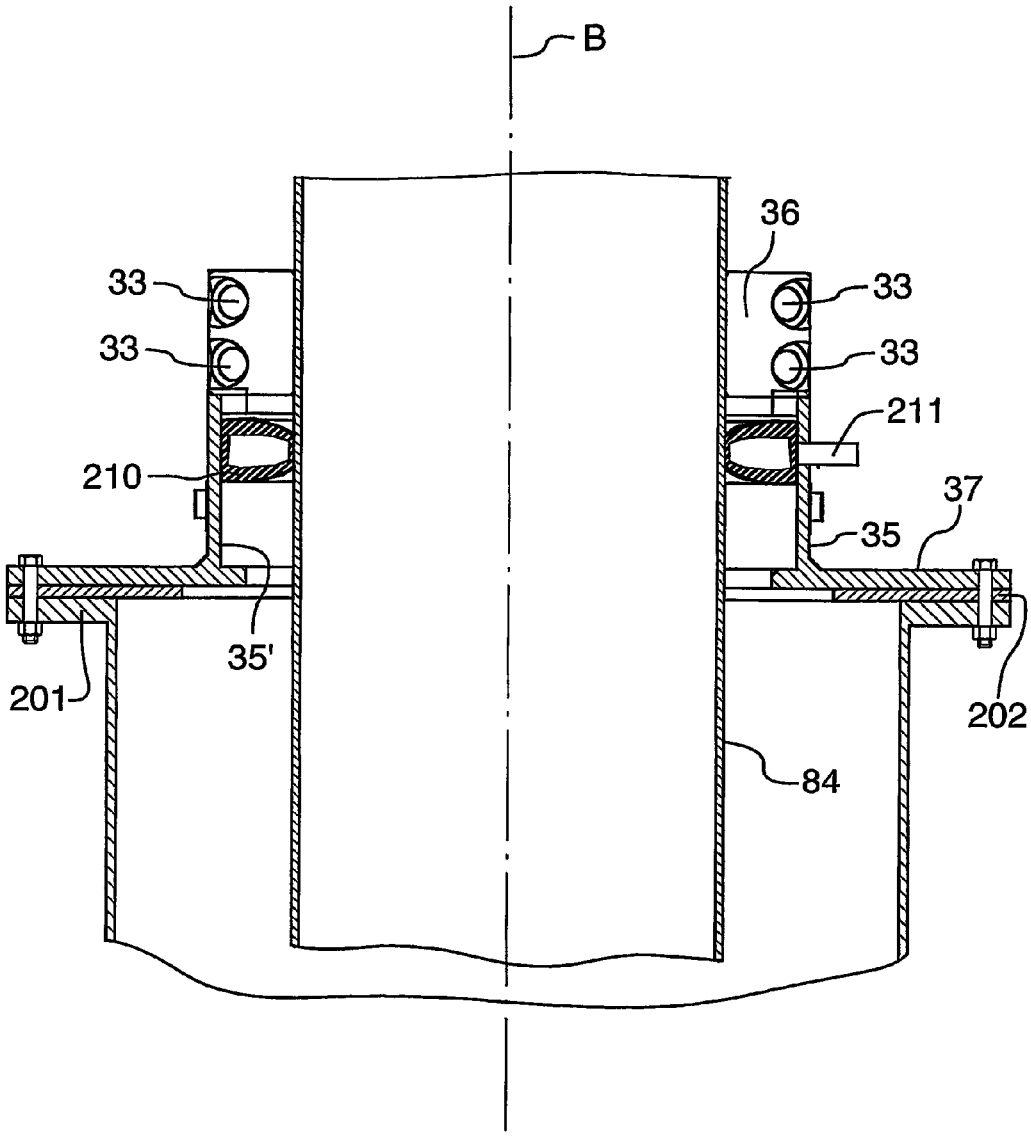
FIG. 8B is a view similar to FIG. 8B, showing the annular seal member inflated to seal against the drive shaft.

The gas sealing means of the preferred embodiment illustrated further comprises a secondary gas sealing means that can be invoked during maintenance of the mixing apparatus 21. As best seen in FIGS. 8A and 8B this secondary gas sealing means comprises a substantially annular seal member 210 mounted on the interior of the annular flange member 35 for selective inflation (by, for example, air under pressure) through valved nozzle 211 to fill the void (212 in FIG. 8A) between the lower drive shaft section and the interior wall 35' of the annular flange 35, when the sleeve member 161 is removed from the mixing apparatus 21 for servicing or maintenance. FIG. 8A shows the sleeve member 161 in place, with the annular seal member 210 deflated, such as would be a normal usage configuration. In contrast, FIG. 8B shows the 161 removed, with annular seal member 210 inflated to seal against the upper drive shaft portion 84 so as to minimize gas leakage from the interior 31 of the vessel 21, such as would be a normal maintenance configuration.

The foregoing provides a useful mixing apparatus 20 which provides for vertical reciprocating motion of the mixing head 30 a stroke distance designated by double headed arrow "S" in FIG. 1, for admixture of the liquid contents 28 of the vessel 21.

One advantage of the mixing apparatus 20 disclosed is its ease of maintenance, in that the upper drive shaft section 82 may, for maintenance or the like, be readily disconnected from the scotch yoke mechanism 40; the four mounting bolts 67 holding the clamp bracket 146 to the drive shaft mounting bracket 89 and the four mounting bolts 60*a* attaching the clamp bracket 146 to the yoke slide 130 need then merely be removed, whereupon the parts are mechanically disconnected, as shown in FIG. 10. Following such disconnection, the bolts (not shown) securing the base plate 118 of the mixer housing 42 (by means of elongate slots 120) to the top plate 55 of the table frame 50 can be loosened, and the mixer housing 42, with the attached motor 108, gear reduction unit 122, reciprocating drive assembly 40, etc. can be slid along the top plate 55 of the table frame 50 in the direction of arrow "L" of FIG. 4 by manipulation of the jack nut 166, as previously described.

Preferentially, substantially annular seal member 210 will be first inflated through the valved nozzle 211 to prevent subsequent gas release from the vessel 21, and the upper drive shaft section 82 will be locked in place against longitudinal sliding prior to the aforementioned disconnection of the upper drive shaft section 82 (so as to avoid the drive shaft 50 and the attached mixing head 30 from dropping precipitously into the vessel 21). This locking function may conveniently be achieved by removing the flexible sleeve member 161 from its gas-sealed connection with the upper annular flange member 204 and with the raised annular flange member 35, and thereafter installing a lock means in the form of a releasable split-circle locking ring 36. The split-circle locking ring 36 has two semi-circular segments that can be tightened together for selectively gripping the outer circumference of the lower drive shaft section 84. Such tightening is accomplished by tightening four tangentially oriented bolts 33 (seen in section in FIG. 8B), where it will be observed that the sleeve member 161 has been removed for servicing, and that the tightened split-circle locking ring is also in longitudinally blocking engagement with the annular flange member 35, thereby to prevent longitudinal sliding thereof relative to the annular flange 35. Once maintenance is completed and the upper drive shaft section 82 is again re-connected to the reciprocating drive assembly 40, the locking ring 36 can be loosened (by loosening of the four tangentially oriented bolts 33), and thereafter removed from frictional engagement with the lower drive shaft portion 84. The sleeve member 161 can then be re-installed to its original gas sealed configuration. Then, the substantially annular seal member 210 can be deflated through the valved nozzle 211, following which the mixing apparatus 20 may again be re-started.

When reinstalling the housing 42, the jack nut 166 may simply be turned in the reverse direction, to urge the housing (in the opposite direction of arrow "L" of FIG. 4) towards the top end 86 of the drive shaft member 50.

Whereas the aforementioned description is directed towards use of the subject mixing apparatus 20 in association with closed vessels, such as municipal sewage digesters, it will be evident that it need not be restricted to use in such applications, for example, the mixing apparatus disclosed could readily be utilized in open vessel mixing, in which case, the gas sealing means, including the sleeve member 161, could be omitted.

Turning to FIGS. 11A through 11F, there will be seen further details of the mixing head 30 used in conjunction with the preferred embodiment of mixing apparatus illustrated in FIGS. 1-10. More particularly, it will be seen that the mixing head 30 of FIGS. 11A through 11F has, in addition to the structures already described above, a reinforcing annulus (or rib) 303 provided adjacent to the outside lower circumference 310 of the ring portion 72 to add strength (and possible additional turbulence) to the mixing head 30 upon said reciprocating longitudinal movement of the mixing head 30. Additionally, in the mixing head of FIGS. 11A through 11F, each of the spokes 74 has an upper spine 74' which is covered with a convex shroud member 304. The shroud members 304 are attached to their respective spines 74' by screws, welding or the like. Their purpose is to minimize the tendency of debris prevalent in the liquid waste 28 found in municipal sewage digesters (such as, for example, rags and hair) from accumulating on the upper spines 74' of the spokes 74, which accumulation causes the motor 108 to draw more power to reciprocate the driving head 30, and may lead to more frequent servicing of the mixing apparatus 20.

FIGS. 12A through 12D illustrate a first alternate embodiment of mixing head 30 in accordance with the present invention which is generally similar to the embodiment of FIGS. 11A through 11F, with the following exceptions. In this embodiment, no reinforcing annulus (or rib) 303 is provided and no convex shroud members 304*a* are provided. However, a convex lip member 305 is provided on the lower surface 306 of the ring portion 72 adjacent to the lower circumference 310 of the ring portion 72. This convex lip member 305 is substantially circular in cross-section, and is added to alter the micro-eddy currents around the outer circumference 310 of the mixing head 30, as it vertically reciprocates in the liquid 28 in the vessel 21, thereby changing the mixing properties in a manner that can be varied depending upon the physical characteristics of the lip member 305, and its proximity to the outer circumference 310.

FIGS. 13A through 13D illustrate a second alternate embodiment of mixing head 30 in accordance with the present invention, which embodiment is generally similar to the embodiment of FIGS. 12A through 12F, with the exception that a convex lip member 309 is provided on the lower surface 306 of the ring portion 72 adjacent to the orifice 75 in encircling relation to said orifice 75. This convex lip member 309 replaces the convex lip member 305 of the previous embodiment. However, as with the previous embodiment illustrated in FIGS. 12A through 12F, the convex lip member 309 is substantially circular in cross-section, and is thought to alter the micro-eddy currents around the orifice 75 of the mixing head 30 as it vertically reciprocates in the liquid 28 in the vessel 21, thereby changing the mixing properties in a manner that can be varied in a controlled manner, depending upon the physical characteristics of the lip member 309 and its proximity to the orifice 75.

Figure 14A:
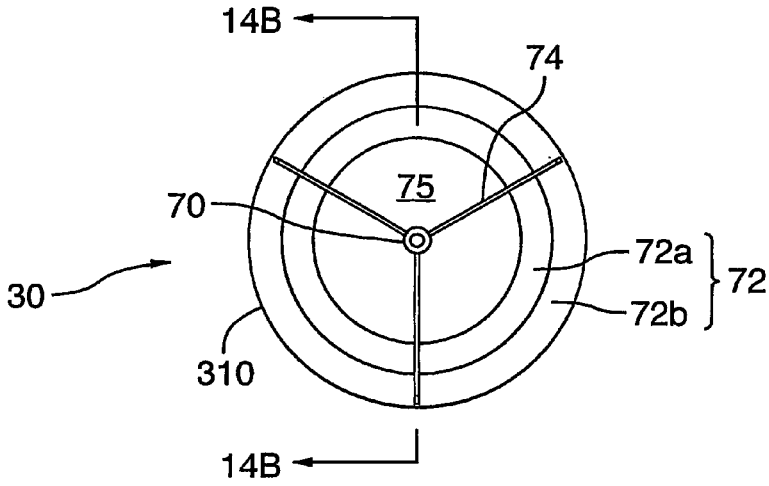
FIG. 14A is a top plan view of a third alternate embodiment for use with the mixing apparatus shown in FIGS. 1-10.
Figure 14B:
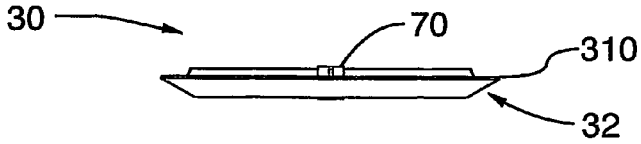
FIG. 14B is a side elevational view of the mixing head of FIG. 14A.
Figure 14C:
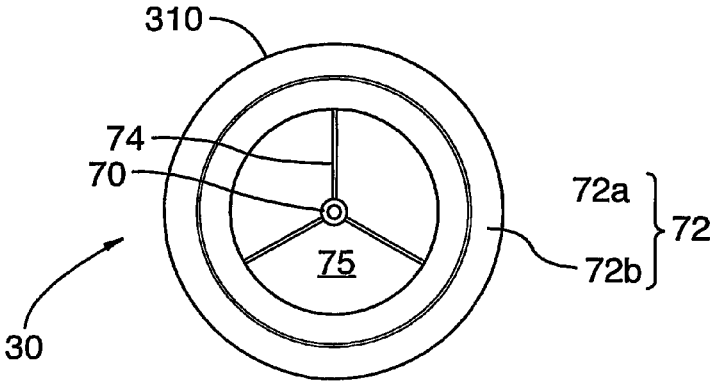
FIG. 14C is a bottom plan view of the mixing head of FIG. 14A.
Figure 14D:
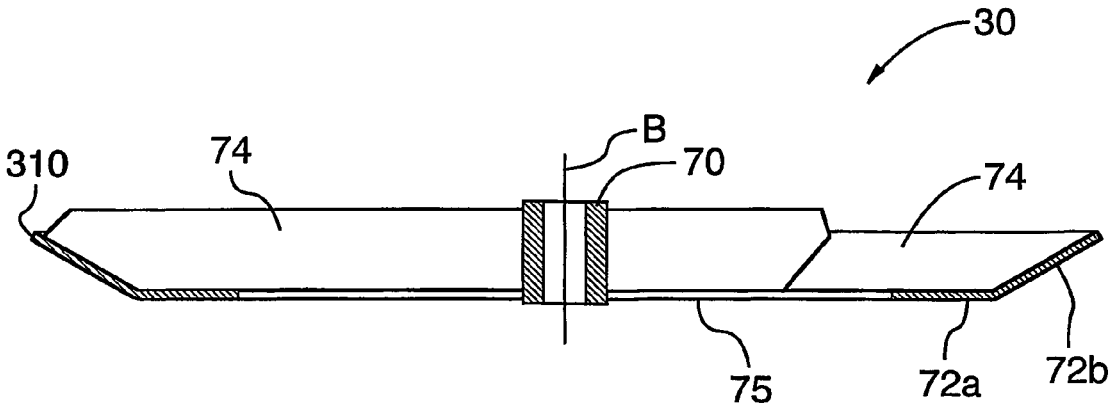
FIG. 14D is a sectional view along sight line 14D-14D of FIG. 14A.
Figure 14E:
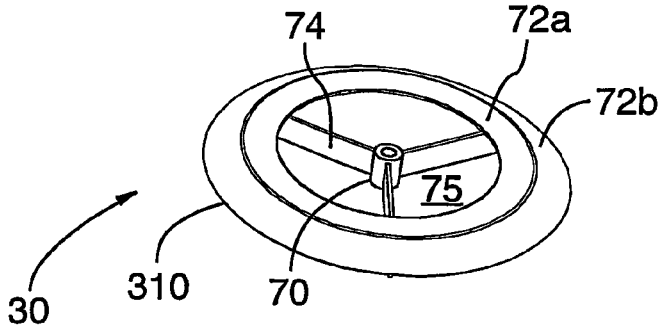
FIG. 14E is a bottom perspective view of the mixing head of FIG. 14A.

FIGS. 14A through 13E illustrate a third alternate embodiment of mixing head 30 in accordance with the present invention. In this embodiment the ring portion 72 is not entirely flat across its extent, as in the embodiments of the other figures; rather, the ring portion 72 has a generally horizontal inner ring section 72*a* adjacent to the orifice 75 that is substantially flat across its extent, and an outer skirt section 72*b* that is contiguous with the inner ring section 72*a*, but extends angularly upwardly from the inner ring section 72*a*, to define by its outer extent, the outside circumference of the ring portion 72. This arrangement causes more turbulence in the vicinity of the outer circumference 310 as the mixing head 30 reciprocates.

Various other modifications and alterations may be used in the design and manufacture of the mixing apparatus according to the present invention without departing from the spirit and scope of the invention, which is limited only by the accompanying claims.

We claim:

1. A mixing apparatus for use with a vessel having a contiguous sidewall substantially centered about and defining a longitudinal axis, the mixing apparatus comprising:

a base plate removably mountable atop the vessel;

a table frame removably mountable atop the base plate;

a housing removably mountable atop the table frame;

a mixing head comprising a generally annular blade body for immersion into the fluids to be mixed within the vessel, the blade body having a centrally positioned hub member defining a substantially vertically directed hub axis, said hub member being attached to and surrounded by a ring portion defining an orifice having a centre of symmetry;

a drive shaft for supporting the mixing head within the vessel and extending from the hub member to the housing;

a reciprocating drive assembly mounted substantially within the housing, the reciprocating drive assembly being operatively connectable to the drive shaft for imparting reciprocating longitudinal movement to the mixing head;

a linear bearing assembly mounted on the table frame in proximal relation to the housing with the drive shaft operatively slidable within said linear bearing assembly;

wherein the mixing apparatus is positionable atop the vessel with the drive shaft, hub axis and centre of symmetry all being substantially aligned with said longitudinal axis; and wherein the housing has a housing base plate adjacent its lower end, the table frame has a top plate adjacent its upper end, and wherein the housing is mountable atop the top plate in removable contacting relation therewith.

2. A mixing apparatus according to claim 1, wherein the housing has a removable front cover plate, the linear bearing assembly is operably mountable on the top plate with its upper end protruding thereabove into the interior of the housing, and wherein the housing is laterally slidable to remove the upper end from within the interior of the housing when the front cover plate of the housing is removed and the drive shaft is operationally disconnected from the reciprocating drive assembly, by means of an open-ended notch formed along a front edge of the housing base plate, said open-ended notch being shaped and dimensioned to surroundingly receive said upper end within the arms of said notch.

3. A mixing apparatus according to claim 2, further comprising a screw jack assembly operatively interconnected between the housing and the table frame for mechanically assisting with said lateral sliding of the housing.

4. A mixing apparatus according to claim 1, wherein the table frame has a plurality of table legs and said table frame is removably mountable atop the base plate by means of said table legs.

5. A mixing apparatus according to claim 4, wherein the drive shaft is comprised of at least two sections being releasably interconnectable one to the other, being an upper drive shaft section and a lower drive shaft section.

6. A mixing apparatus according to claim 5, wherein the upper drive shaft section is dimensioned and otherwise adapted to extend from its operative connection with the reciprocating drive assembly through the linear bearing to a point of releasable interconnection with the lower drive shaft section, which point is, at all times of operation of the mixing apparatus, located above the base plate.

7. A mixing apparatus according to claim 6, wherein the lower drive shaft section extends from said point of releasable interconnection with the upper drive shaft section through an aperture in the base plate to terminate at a point of connection with the hub member.

8. A mixing apparatus according to claim 7, wherein a raised annular flange member is mounted on the base plate in encircling relation to said aperture, and a lock means is provided for selectively interacting with said lower drive shaft member and said annular flange member to prevent longitudinal sliding of the lower drive shaft section relative to said annular flange member.

9. A mixing apparatus according to claim 8, wherein said lock means comprises a releasable split-circle locking ring.

10. A mixing apparatus according to claim 1, wherein the reciprocating drive assembly comprises:

a scotch yoke mechanism having:

a flywheel mounted for rotation about a rotational axis extending substantially normal to the longitudinal axis;

a crank member projecting from the flywheel in a direction substantially parallel to the rotational axis;

a yoke slide supported by the housing for movement along a yoke axis disposed substantially parallel to the longitudinal axis, the yoke slide being releasably connected to the shaft, the yoke slide having a substantially linear race with upper and lower opposed surfaces formed therein for operative contact by the crank member, the race being disposed within the yoke slide with the upper and lower opposed surface each being oriented substantially normal to both the rotational axis and the yoke axis;

first and second guide assemblies operatively connected to the housing, and to the yoke slide for sliding engagement therewith along a pair of guide axes extending substantially parallel to the yoke axis, said first and second guide assemblies being laterally spaced from each other with the yoke slide disposed substantially therebetween; wherein when the flywheel is rotatively driven, the crank member is caused to translate linearly within the race thereby urging the yoke slide to slidingly engage the guide assemblies and move along the yoke axis to effect longitudinal reciprocating movement of the shaft and the mixing head.

11. A mixing apparatus according to claim 10, wherein each of the first and second guide assemblies is a linear slide assembly.

12. A mixing apparatus according to claim 10, wherein each of the upper and lower opposed surfaces of the linear race is clad with a respective upper and lower bearing plate removably fastened thereto.

13. A mixing apparatus according to claim 12, wherein the scotch yoke mechanism further comprises a wear plate block having removable upper and lower wear plates, said wear plate bock having a bore formed therein to operatively receive the crank member in rotatable driving relation, the wear plate block being mountable for constrained sliding movement between the upper and lower opposed surfaces, with the upper and lower wear plates being in frictional sliding contact with a respective one of the upper and lower bearing plates.

14. A mixing apparatus according to claim 13, wherein a means for lubricating the surface of at least one of the upper and lower bearing plates is provided.

15. A mixing apparatus according to claim 14, wherein said means for lubricating comprises an oil storage reservoir mounted on the yoke slide at a position above the level of said at least one of the upper and lower bearing plates, said reservoir being in fluid communication with an oil flow control means positioned between said oil reservoir and an operative contacting surface of said at least one of the upper and lower bearing plates; and one or more oil delivery channels extending from said oil flow control means to one or more oil delivery ports positioned on said operative contacting surface for delivery of oil placed in the oil storage reservoir to said at least one of the upper and lower bearing plates.

16. A mixing apparatus according to claim 15, wherein one or more oil delivery channels and one or ore oil delivery ports are provided in each of said upper and lower bearing plates, wherein two oil storage reservoirs are provided as aforesaid on the yoke slide, with each reservoir being in fluid communication with a respective oil flow control means positioned between said reservoir and the respective operative contacting surface of said at least one of the upper and lower bearing plates, such that delivery of oil placed in the respective oil reservoir is delivered to the respective one of the upper and lower bearing plates.

17. A mixing apparatus according to claim 16, wherein said oil flow control means is a felt pad extending across the entranceway to said one or more oil delivery channels.

18. A mixing apparatus according to claim 11, wherein a means for providing lubrication to each of the linear slide assemblies of the first and second guide means is provided.

19. A mixing apparatus according to claim 18, wherein the linear slide assemblies each comprise a track slide with one or more slide bogies, said one or more slide bogies being retained on the track slide for operative sliding engagement along a respective one of said guide axes defined by the track slide, and wherein said means for providing lubrication to each of the linear slide assemblies comprises a grease channel extending from a grease port positioned on each slide bogie in overlying relation to its respective track slide, said grease port being in fluid communication with a grease nipple positioned on the bogie and adapted to selectively accept lubricating grease for distribution through said grease channel onto said respective one of the track slides as said yoke slide moves along the yoke axis as aforesaid.

20. A mixing apparatus according to claim 1, wherein the hub member is attached to the ring portion in overlying relation to the orifice and the ring portion by means of a plurality of spokes extending radially outwardly from the hub member.

21. A mixing apparatus according to claim 20, wherein each of the spoke members has an upper spine with a convex shroud member attached thereto in downwardly sloping, overlying relation.

22. A mixing apparatus according to claim 20, wherein a convex lip member is positioned on a lower surface of the ring portion adjacent to the orifice in encircling relation thereto.

23. A mixing apparatus according to claim 20, wherein a convex lip member is positioned on a lower surface of the ring portion adjacent to the outside circumference of the ring portion.

24. A mixing apparatus according to claim 20, wherein the ring portion is comprised of a generally horizontal inner ring section surrounding and defining said orifice, and an outer skirt section contiguous with said inner ring section and extending angularly upwardly from said inner ring section to define by its outer extent the outside circumference of said ring portion.

25. A mixing apparatus according to claim 1, wherein a reinforcing annulus is provided adjacent to the outside circumference of the ring portion.

26. A mixing apparatus according to claim 20 wherein a reinforcing annulus is provided adjacent to the outside lower circumference of the ring portion.

27. A mixing apparatus according to claim 1, wherein a convex lip member is positioned on the ring portion adjacent to the orifice in encircling relation thereto.

28. A mixing apparatus according to claim 1, wherein a convex lip member is positioned on the ring portion adjacent to the outside circumference of the ring portion.

29. A mixing apparatus for mixing liquids in a sealed vessel having a top wall and a contiguous sidewall substantially centered about and defining a longitudinal axis, the mixing apparatus comprising:

a base plate removably mountable on the top wall in sealed relation therewith;

a table frame removably mountable atop the base plate;

a housing removably mountable atop the table frame;

a mixing head comprising a generally annular blade body for immersion into the fluids to be mixed within the vessel, the blade body having a centrally positioned hub member defining a substantially vertically directed hub axis, said hub member being attached to and surrounded by a ring portion defining an orifice having a centre of symmetry;

a drive shaft for supporting the mixing head within the vessel and extending from the hub member through an aperture in the base plate and into the housing;

a reciprocating drive assembly mounted substantially within the housing, the reciprocating drive assembly being operatively connectable to the drive shaft for imparting reciprocating longitudinal movement to the mixing head;

a linear bearing assembly mounted on the table frame in proximal relation to the housing with the drive shaft operatively slidable within said linear bearing assembly;

sealing means for substantially preventing gasses formed in the vessel above said liquid from escaping to atmosphere through the aperture in the base plate;

wherein the mixing apparatus is positionable atop the vessel with the drive shaft, hub axis and centre of symmetry all being substantially aligned with said longitudinal axis; and wherein the housing has a housing base plate adjacent its lower end, the table frame has a top plate adjacent its upper end, and wherein the housing is mountable atop the top plate in removable contacting relation therewith.

30. A mixing apparatus according to claim 29, wherein the housing has a removable front cover plate, the linear bearing assembly is operably mountable on the top plate with its upper end protruding thereabove into the interior of the housing and its lower end protruding below the top plate, and wherein the housing is laterally slidable to remove the upper end from within the interior of the housing when the front cover plate of the housing is removed and the drive shaft is operationally disconnected from the reciprocating drive assembly, by means of an open-ended notch formed along a front edge of the housing base plate, said open-ended notch being shaped and dimensioned to surroundingly receive said upper end within the arms of said notch.

31. A mixing apparatus according to claim 30, further comprising a screw jack assembly operatively interconnected between the housing and the table frame for mechanically assisting with said lateral sliding of the housing.

32. A mixing apparatus according to claim 30, wherein the table frame has a plurality of table legs and said table frame is removably mountable atop the base plate by means of said table legs.

33. A mixing apparatus according to claim 32, wherein the drive shaft is comprised of at least two sections being releasably interconnectable one to the other, being a upper drive shaft section and a lower drive shaft section.

34. A mixing apparatus according to claim 33, wherein the upper drive shaft section is dimensioned and otherwise adapted to extend from its operative connection with the reciprocating drive assembly through the linear bearing to a point of releasable interconnection with the lower drive shaft section, which point is, at all times of operation of the mixing apparatus, located above the base plate.

35. A mixing apparatus according to claim 34, wherein the lower drive shaft section extends from said point of releasable interconnection with the upper drive shaft section through said aperture in the base plate to terminate at a point of connection with the hub member.

36. A mixing apparatus according to claim 35, wherein said sealing means comprises a lower annular flange member mounted atop the base plate in gas sealing relation thereto and in encircling relation to said aperture, an upper annular flange member mounted on the underside of said top plate in gas sealing relation to said top plate and in encircling relation to the lower end of said linear bearing assembly, one or more resilient seal means mounted within the linear bearing assembly in encircling gas sealing relation to the upper drive shaft section, and a sleeve member extending from said lower annular flange member to said upper annular flange member, said sleeve member being releasably connectable to both of said annular flanges in gas sealing encircling relation thereto.

37. A mixing apparatus according to claim 35, wherein said sleeve member is a corrugated, bellows-style flexible tube member constructed from resilient rubber material.

38. A mixing apparatus according to claim 37, wherein said sealing means additionally comprises a substantially annular seal member mounted on the interior of the annular flange member for selective inflation to fill the void between the lower drive shaft section and the interior of said flange when said sleeve member is removed from the mixing apparatus for servicing thereof.

* * * * *